US007279262B2

(12) United States Patent
Fujikawa et al.

(10) Patent No.: US 7,279,262 B2
(45) Date of Patent: Oct. 9, 2007

(54) MAGNETIC CARRIER AND TWO-COMPONENT DEVELOPER

(75) Inventors: Hiroyuki Fujikawa, Kanagawa (JP); Takayuki Itakura, Shizuoka (JP); Takakuni Kobori, Shizuoka (JP); Koh Ishigami, Shizuoka (JP); Nobuyoshi Sugahara, Shizuoka (JP); Yoshinobu Baba, Kanagawa (JP); Hirohide Tanikawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 427 days.

(21) Appl. No.: 10/988,687

(22) Filed: Nov. 16, 2004

(65) Prior Publication Data

US 2005/0112489 A1 May 26, 2005

(30) Foreign Application Priority Data

Nov. 20, 2003 (JP) ..... 2003-390430
Apr. 26, 2004 (JP) ..... 2004-129938

(51) Int. Cl.
*G03G 9/113* (2006.01)

(52) U.S. Cl. ..... 430/111.35; 430/111.4

(58) Field of Classification Search ..... 430/111.35, 430/111.32, 111.33
See application file for complete search history.

(56) References Cited

U.S. PATENT DOCUMENTS 5,821,023 A 10/1998 Shibuya et al. ..... 430/108.6
6,124,067 A 9/2000 Mikuriya et al. ..... 430/111.3
2004/0253529 A1 12/2004 Baba et al. ..... 430/111.35

FOREIGN PATENT DOCUMENTS

| | | |
|---|---|---|
| JP | 09/281807 | 10/1997 |
| JP | 10/307429 | 11/1998 |
| JP | 2000-39740 | 2/2000 |
| JP | 3173374 B2 | 6/2001 |

*Primary Examiner*—Christopher RoDee
(74) *Attorney, Agent, or Firm*—Fitzpatrick, Cella, Harper & Scinto

(57) ABSTRACT

A magnetic carrier composed of carrier particles is provided in which each carrier particle has a carrier core including magnetic fine particles and a binder resin with the carrier core surface being coated with a coat material containing a coat resin. In the magnetic carrier, Fatom/Catom and (Fatom/Catom)/(Fcalc/Ccalc) are respectively in specific ranges, wherein Fatom and Catom represent respectively a fluorine element abundance ratio and a carbon element abundance ratio at the magnetic carrier particle surface, and Fcalc and Ccalc represent respectively a fluorine element abundance ratio and a carbon element abundance ratio which are calculable from the molecular structure of the coat resin.

In addition, a two-component developer is provoded including the magnetic carrier and a toner having a specific contact angle against water.

21 Claims, 3 Drawing Sheets

MAGNETIC CARRIER AND TWO-COMPONENT DEVELOPER

This application claims priority from Japanese Patent Application Nos. 2003-390430 filed on Nov. 20, 2003 and 2004-129938 filed on Apr. 26, 2004, which are hereby incorporated by reference herein.

BACKGROUND OF THE INVENTION

1. Field of the Invention

This invention relates to a two-component developer used in electrophotography, electrostatic recording and electrostatic printing, and a magnetic carrier included in the developer.

2. Related Background Art

Conventionally, in image forming apparatus making use of electrophotography, such as printers and copying machines, two-component developers containing toners and carriers are preferably used from the viewpoint of image quality, running performance and high-speed adaptability. As a method of performing development using such two-component developers, in order to secure sufficient image density and enhance fine-line reproducibility, a method is employed in which development is performed in the state a magnetic brush of a developer is brought into contact with a photosensitive member, the peripheral speed of a developing sleeve is made higher than the peripheral speed of the photosensitive member, and an alternating electric field and a direct-current electric field are superimposed.

As magnetic carriers used in such a contact two-component development, they are required to have dielectric breakdown strength resistant to applied voltage, and hence magnetic materials such as ferrite and magnetite the particle surfaces of which are coated with insulating resins are used. However, the carrier is made insulative by the resin coating and comes not to function as a development electrode at the time of development, thereby causing image defects such as called blank areas where an edge effect appears between halftone and solid black.

To remedy such image defects and further to stabilize charging of the toner over a long period of time, it has been proposed that fine resin particles containing a conductive powder is dispersed in a coat material containing a coat resin (see, e.g., Japanese Patent Application Laid-Open No. H10-307429, pages 2 to 4). It has been further proposed to use as a coat material a resin having a critical surface tension of 35 dyne/cm or less and in which fine resin particles and a conducting material have been dispersed (see, e.g., Japanese Patent No. 3173374, pages 2 to 6 and Table 1).

The above means can prevent image defects from occurring and further prevent carrier particle surfaces from contamination (spent). However, since ferrite particles are used as core particles, brush images of a developer magnetic brush tend to appear in the contact two-component development, and also the stress applied to the toner when low-consumption printing is continued may cause the toner to deteriorate, resulting in such a problem that it is difficult for the toner to come away from the carrier.

Accordingly, it has been proposed to use a magnetic carrier of a magnetic fine particle dispersion type in order to lower magnetic force and increase electrical resistance (see, e.g., Japanese Patent Application Laid-Open No. H09-281807, pages 2 to 8).

It has been further proposed to prevent toner-spent by the use of a magnetic carrier whose magnetic fine particle dispersed cores have been coated on their surfaces with a aminosilane coupling agent and a resin having a unit such as a fluoroalkyl unit or a methylene unit (see, e.g., Japanese Patent Application Laid-Open No. 2000-39740, pages 9 to 15 and FIG. 1).

These means allow the carrier to have a high specific resistance, prevent image defects such as blank areas by using a carrier having relatively low magnetic force and rotating the developing sleeve and the photosensitive member counter to each other, afford high image density and superior dot reproducibility, and also remedy carrier contamination. However, where the process speed has been made higher as a result of the achievement of further high speed, the developer magnetic brush in a developing zone may have strong frictional force against the photosensitive member to cause the developer to deteriorate. Also, a system in which the development is performed in the state the developing sleeve and the photosensitive member are rotated contrary to each other tends to cause brush images (white lines) due to the friction of the magnetic brush especially in the case of high-speed processing, as compared with a system in which the development is performed in the state the developing sleeve and the photosensitive member are rotated in the forward direction. Also, the amount of developer (image density) and changes in the amount of developer (gamma curve) with respect to gradations of potential tend to be influenced by changes in, e.g., the distance between the developing sleeve and the photosensitive member, the intensity of the alternating electric field and the amount of the developer held on the developing sleeve.

SUMMARY OF THE INVENTION

An object of the present invention is to provide a magnetic carrier and a two-component developer which have solved the problems discussed above.

More specifically, an object of the present invention is to provide a magnetic carrier and a two-component developer which are not causative of image defects such as blank areas and promise high image density and superior dot reproducibility.

A further object of the present invention is to provide a magnetic carrier and a two-component developer which are less causative of coat material peeling from the magnetic-carrier particles even in an environment of elevated temperature and can maintain stable carrier particle surfaces over a long period of time.

As a result of many extensive studies, the present inventors have discovered that the above requirements can be satisfied where, in a magnetic carrier comprising magnetic fine particle dispersed resin cores coated on their surfaces with a coat material containing a coat resin, the magnetic carrier has a certain specific element distribution at its particle surfaces. Thus, they have accomplished the present invention.

More specifically, the above objects can be achieved by using the following magnetic carrier and two-component developer:

(1). A magnetic carrier comprising carrier particles, wherein;

each carrier particle comprises a carrier core and a coat material for coating the carrier core, the carrier core comprises at least a binder resin and magnetic particles dispersed in the binder resin, the coat material has a coat resin, a ratio (A) of a fluorine element abundance ratio (Fatom) to a carbon element abundance ratio (Catom), Fatom/Catom, at the surface of the carrier particle is from 0.10 to 0.85, and a ratio ((A)/(B)) of "a ratio (A) of a fluorine element abundance ratio (Fatom) to a carbon element abundance ratio (Catom), Fatom/Catom, at the surface of the carrier particle" to "a ratio (B) of a fluorine element abundance ratio (Fcalc) to a carbon element abundance ratio (Ccalc) that is theoretically calculable from the molecular structure of the coat resin, Fcalc/Ccalc", i.e., (Fatom/Catom)/(Fcalc/Ccalc), is from 1.01 to 3.00.

(2) The magnetic carrier described in (1), wherein the ratio (Fatom/Catom)/(Fcalc/Ccalc) is from 1.10 to 2.00.

(3) The magnetic carrier described in (1), which has a specific resistance of from $1\times10^{7}$ Ω·cm to $1\times10^{11}$ Ω·cm.

(4) The magnetic carrier described in (1), which has a BET specific surface area (BET 1) of from 0.02 $m^2/g$ to 0.20 $m^2/g$ as measured by a BET method.

(5) The magnetic carrier described in (4), wherein the magnetic carrier cores have a BET specific surface area (BET 2) of from 0.02 $m^2/g$ to 0.20 $m^2/g$ as measured by a BET method.

(6) The magnetic carrier described in (5), wherein the BET specific surface area (BET 1) is from 0.02 $m^2/g$ to 0.19 $m^2/g$ and the BET specific surface area (BET 2) is from 0.03 $m^2/g$ to 0.20 $m^2/g$, and the BET specific surface area (BET 1) and the BET specific surface area (BET 2) satisfy BET 1<BET 2.

(7) The magnetic carrier described in (1), wherein the magnetic particles have a BET specific surface area (BET 3) of from 2.0 $m^2/g$ to 20.0 $m^2/g$ as measured by the BET method.

(8) The magnetic carrier described in (1), wherein the carrier cores contain the magnetic particles and further non-magnetic inorganic compound particles.

(9) The magnetic carrier described in (8), wherein the non-magnetic inorganic-compound particles have a BET specific surface area (BET 4) of from 1.0 $m^2/g$ to 10.0 $m^2/g$ as measured by a BET method, and the BET specific surface area (BET 3) and the BET specific surface area (BET 4) satisfy BET 3>BET 4.

(10) The magnetic carrier described in (1), wherein the coat resin is a polymer or copolymer which comprises a methacrylate unit or acrylate unit having a perfluoroalkyl unit represented by the formula:

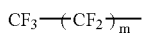

wherein m represents an integer of any of from 1 to 20.

(11) The magnetic carrier described in (1), wherein the coat resin is a polymer or copolymer which comprises a methacrylate unit or acrylate unit having a perfluoroalkyl unit represented by the formula:

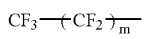

wherein m represents an integer of any of from 5 to 9.

(12) The magnetic carrier described in (1), wherein the coat resin is a polymer or copolymer which comprises a unit represented by the formula:

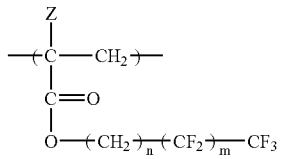

wherein Z represents a hydrogen atom or an alkyl group, m represents an integer of any of from 1 to 20, and n represents an integer of any of from 1 to 10.

(13) The magnetic carrier described in (1), wherein the coat material is in an amount of from 0.3 part by weight to 4.0 parts by weight based on 100 parts by weight of the carrier cores.

(14) The magnetic carrier described in (1), which has a contact angle to water of from 95° to 125°.

(15) The magnetic carrier described in (1), wherein the coat material contains fine particles in an amount of from 1 part by weight to 40 parts by weight based on 100 parts by weight of the coat resin.

(16) The magnetic carrier described in (15), wherein the fine particles contained in the coat material are at least one of fine resin particles and conductive fine particles.

(17) The magnetic carrier described in (16), wherein the fine resin particles are selected from fine cross-linked polymethyl methacrylate resin particles, fine cross-linked polystyrene resin particles and fine melamine resin particles, and one or two or more kinds of fine resin particles are contained.

(18) The magnetic carrier described in (16), wherein the conductive fine particles are selected from fine carbon black particles, fine magnetite particles, fine graphite particles, fine titanium oxide particles, fine alumina particles, fine zinc oxide particles and fine tin oxide particles.

(19) The magnetic carrier described in (1), wherein the carrier cores contain the magnetic fine particles in an amount of from 70 parts by weight to 95 parts by weight based on 100 parts by weight of the carrier cores.

(20) The magnetic carrier described in (1), which has a true specific gravity of from 2.5 $g/cm^3$ to 4.0 $g/cm^3$.

(21) A two-component developer which comprises a toner and a magnetic carrier, wherein the toner has toner particles containing at least a binder resin, a release agent and a colorant, and the transmittance of light having a wavelength of 600 nm through a dispersion prepared by dispersing the toner in a 45% by volume methanol aqueous solution is from 10% to 70%; and the magnetic carrier comprises carrier particles, wherein;

each carrier particle comprises a carrier core and a coat material for coating the carrier core, the carrier core comprises at least a binder resin and magnetic particles dispersed in the binder resin, the coat material has a coat resin, a ratio (A) of a fluorine element abundance ratio (Fatom) to a carbon element abundance ratio (Catom), Fatom/Catom, at the surface of the carrier particle is from 0.10 to 0.85, and a ratio ((A)/(B)) of "a ratio (A) of a fluorine element abundance ratio (Fatom) to a carbon element abundance ratio (Catom), Fatom/Catom, at the surface of the carrier particle" to "a ratio (B) of a fluorine element abundance ratio (Fcalc) to a carbon element abundance ratio (Ccalc) that is theoretically calculable from the molecular structure of the coat resin, Fcalc/Ccalc", i.e., (Fatom/Catom)/(Fcalc/Ccalc), is from 1.01 to 3.00.

(22) The two-component developer described in (21), wherein the magnetic carrier is the magnetic carrier described in any one of (2) to (20).

BRIEF DESCRIPTION OF THE DRAWINGS

FIGS. 2-1, 2-2 and 2-3 are schematic views showing the state of the blank area in the present invention.

DESCRIPTION OF THE PREFERRED EMBODIMENTS

In a magnetic carrier comprising carrier particles each of which has a carrier core comprising a binder resin with magnetic particles dispersed therein, whose surface is coated with a coat material containing a coat resin, the present invention in which the surfaces of the carrier particles have been specified makes it possible to effectively prevent image defects such as blank areas and provide images having high image density and superior dot reproducibility.

Figure 1:
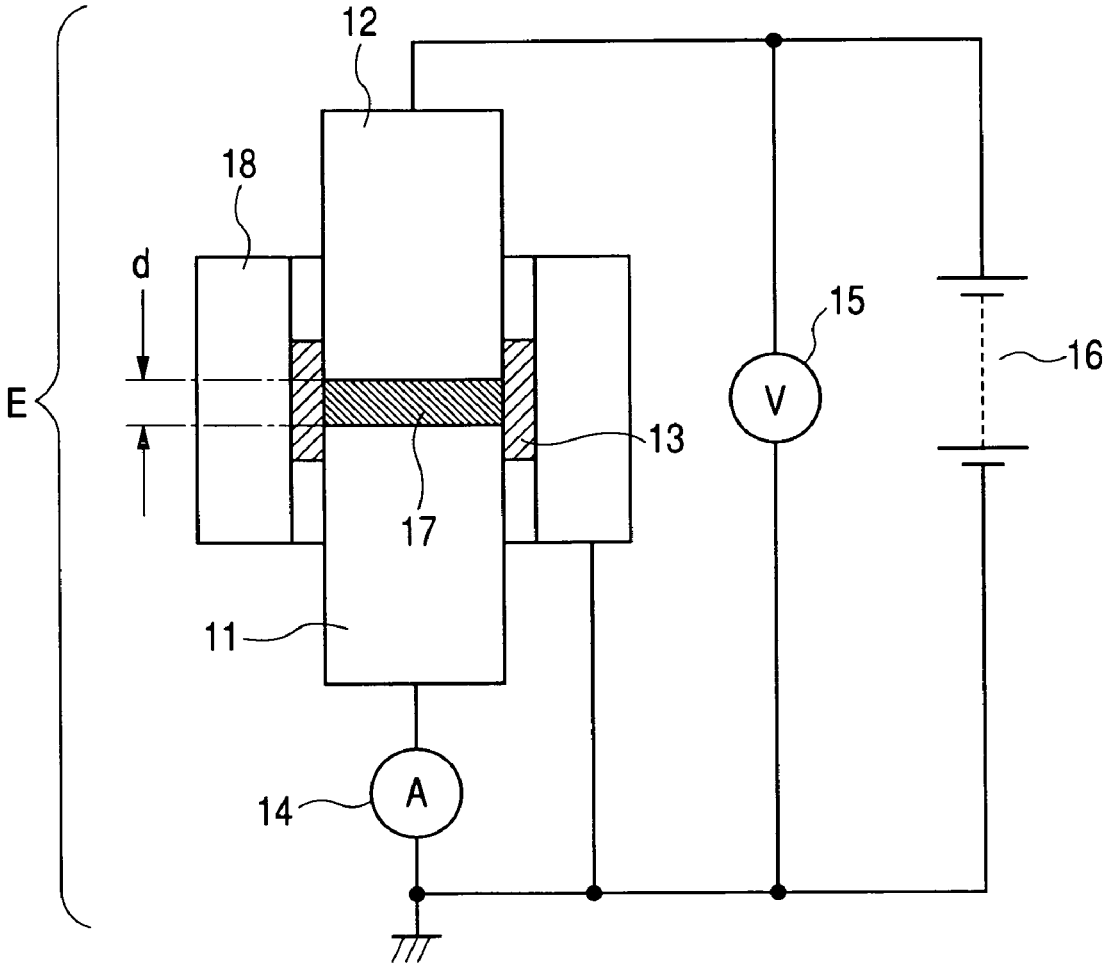
FIG. 1 is a schematic sectional view of an instrument which measures the specific resistance of the magnetic carrier of the present invention, the magnetic fine particles and the non-magnetic fine inorganic-compound particles.
Figures 1, 2:
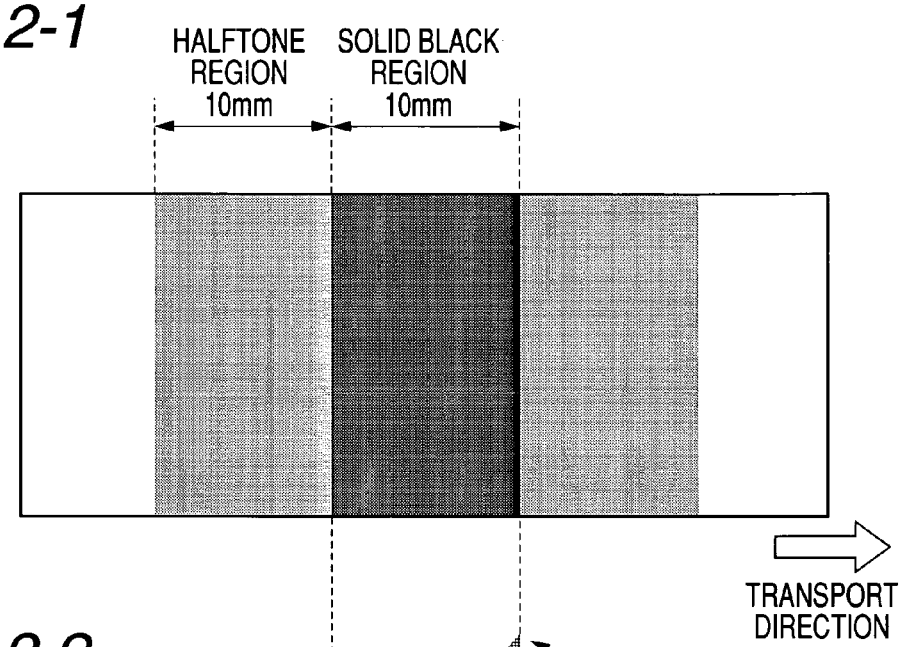
Figure 2:
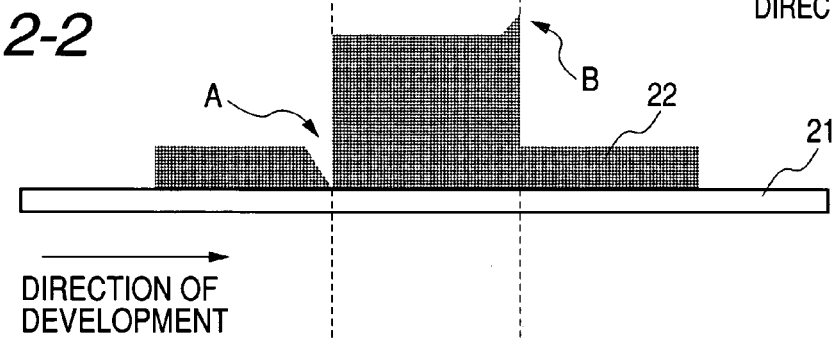
Figures 2, 3:
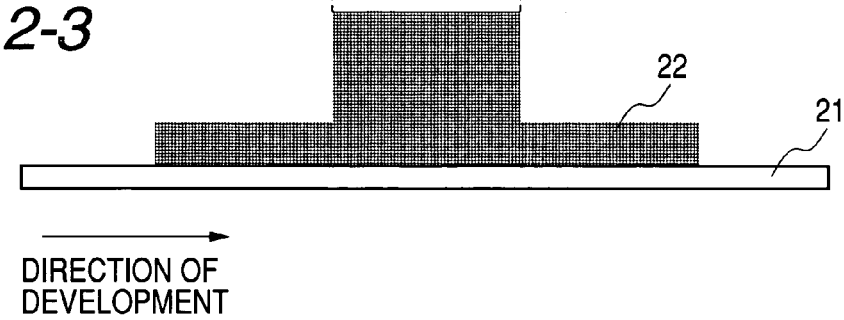

The blank areas are explained with reference to FIGS. 2-1 to 2-3. FIGS. 2-1 to 2-3 show an enlarged view (2-1) of an image in which an actual blank area has appeared, a diagrammatic view (2-2) of a cross section of a toner layer which forms the image on that occasion, and a diagrammatic view (2-3) of an ideal state (a state free of blank areas). The view (2-1) shows an image obtained by development performed in the order of a halftone area, a solid area and a halftone area from the left side in the direction of development with a toner in the system in which the development is performed in the state the developing sleeve and the photosensitive member are rotated in the forward direction. The white portion between the left-side halftone area and the solid area is called "blank area(s)" in the present invention. The view (2-2) cross-sectionally shows the state of that image as viewed from the side. In FIGS. 2-1 to 2-3, the reference numeral 21 denotes a transfer material; and 22, the cross section of the toner layer. In FIGS. 2-1 to 2-3, the portion indicated by A is the blank area, where no tone layer is present in the boundary region between the halftone area and the solid area. Also, the phenomenon called "sweep-together" (indicated by B in FIGS. 2-1 to 2-3) where the toner layer is raised at the boundary between the solid area and the halftone area subsequently developed. The "blank area" and the "sweep-together" occur by the same mechanism, and hence the blank area is detailed herein.

The image defects such as blank areas come about when a line of electric force goes around from the developing sleeve toward the photosensitive member in the development pole. Where the specific resistance of a carrier is low to a certain degree, the carrier plays a role as an electrode, and a state occurs in which the electrode is present in appearance in the vicinity of the photosensitive member pole, where a line of electric force can be kept from going around and hence the edge effect can not easily come about, so that the image defects such as blank areas can not easily occur. However, where the specific resistance of a carrier is high, an electric field is applied to the part between the photosensitive member and the developing sleeve (hundreds of micrometers), and hence a line of electric force is in a form that it expands around the part where they stand closest. Thus, it has turned out that, at the rear end of a development nip zone (the part where the developer is in contact with the photosensitive member), counter charges of carrier particle surfaces remain after the toner has flown from the carrier through development, and, where the specific resistance of the carrier is high, the toner incorporated in the development is drawn back by the counter charges to cause the blank areas. Therefore, it has turned out that the blank areas can be remedied by the carrier having a low specific resistance so that the carrier may function as an electrode to keep a line of electric force from going around, and may so function as to leak the electric charges remaining on the carrier particle surfaces after development. However, when using the carrier having a low specific resistance, the photosensitive member is rubbed with it to disrupt latent images, so that the halftone area may come coarse. It has also turned out that, even in using a carrier having a high specific resistance, the carrier after development leaves instantaneously the developing zone not to cause any drawing-back of the toner in the case where the development is performed in the state the developing sleeve and the photosensitive member are rotated in the counter direction. However, scavenging by the magnetic brush may occur due to too large difference in peripheral speed with respect to the photosensitive member.

It has further been found that it is effective against the blank areas that the toner incorporated in development in a quantity sufficient for latent-image potential, because there can be no potential difference between the halftone area and the solid-image area thus preventing a line of electric force from going around. Hence, what is important is developing performance that satisfies latent-image potential sufficiently.

Accordingly, in the magnetic carrier of the present invention, the fluorine element in the coat material is selectively oriented, and besides the abundance ratio of the fluorine element at the particle surfaces of the magnetic carrier is controlled to enable the releasability of the toner from the magnetic carrier particle surfaces to be controlled, so that the toner coming-away performance at the time of development can be improved, the image defects such as blank areas can be remedied and superior dot reproducibility can be achieved. Thus, the present invention has been accomplished.

The present invention is described below in detail.

In the magnetic carrier of the present invention comprising carrier cores which contain at least magnetic particles and a binder resin and are coated on their surfaces with a coat material having a coat resin, the magnetic carrier is characterized in that the ratio of fluorine element abundance ratio (Fatom) to carbon element abundance ratio (Catom), Fatom/Catom, at the particle surfaces of the magnetic carrier is from 0.10 to 0.85. It may be preferably from 0.12 to 0.75, and more preferably from 0.15 to 0.65.

The reason therefor is as follows. Where the ratio of fluorine element abundance ratio (Fatom) to carbon element abundance ratio (Catom), Fatom/Catom, at the particle surfaces of the magnetic carrier is within the above range, the fluorine element abundance ratio at the particle surfaces of the magnetic carrier coated with a coat material can be raised, and hence the surface energy of the particle surfaces of the magnetic carrier can be lowered. This enables the releasability of the toner from the magnetic carrier particle surfaces to be controlled, so that the toner coming-away performance at the time of development can be improved and the image defects such as blank areas can be remedied.

If the ratio Fatom/Catom is less than 0.10, the effect of release of the toner from the magnetic carrier particle surfaces may be difficult to bring about and the toner coming-away performance is lowered, tending to cause the image defects such as blank areas.

If the ratio Fatom/Catom is more than 0.85, the effect of release of the toner from the magnetic carrier particle surfaces may be effectively exhibited to improve the toner coming-away performance, but charging tends to be unstable, resulting in poor dot reproducibility and also poor environmental stability, which is undesirable.

As a method of controlling the fluorine element abundance ratio at the particle surfaces, in the process of coating to obtain the magnetic carrier, the step of mixing carrier cores and the coat material and the step of drying and/or the step of cooling may be controlled to arrange fluorine elements preferentially on the particle surfaces of the magnetic carrier, whereby the fluorine element abundance ratio can increase at the particle surfaces. Stated specifically, the step of drying and/or the step of cooling are preferably carried out under the conditions of a small absolute water content in an ambient atmosphere. This is considered to be due to the fact that since the carrier cores are hydrophilic, hydrophilic components in the coat resin contained in the coat material are arranged on the surfaces of carrier cores, whereas hydrophobic fluorine element monomers are arranged on the particle surfaces of the magnetic carrier.

In the present invention, it is characteristic that the coat material has selective fluorine element distribution from the surfaces of carrier cores toward the particle surfaces of the magnetic carrier. This can improve resistance to the peeling of the coat material from the cores, and also can improve releasability of the toner from the magnetic carrier particle surfaces.

Also in the present invention, the ratio of fluorine element abundance ratio to carbon element abundance ratio that is theoretically calculable from the molecular structure of the coat resin contained in the coat material is compared with the ratio of fluorine element abundance ratio to carbon element abundance ratio at actual magnetic carrier particle surfaces, whereby it can be confirmed that the fluorine elements are preferentially arraged.

Then, the ratio of fluorine element abundance ratio (Fcalc) to carbon element abundance ratio (Ccalc) that is theoretically calculable from the molecular structure of the coat resin, Fcalc/Ccalc, may preferably be from 0.05 to 0.75. If it is less than 0.05, the toner release effect ascribable to the fluorine element may be difficult to bring about. If it is more than 0.75, the toner release effect may come large, but on the other hand the releasability of the coat material from carrier cores may come high, and the adherence to carrier cores may lower, resulting in poor resistance to peeling from carrier cores. Also, the particle surfaces of the magnetic carrier coated with the coat material may have poor durability, resulting in low charge-providing performance.

In the present invention, it is further characteristic that the ratio of "the ratio of fluorine element abundance ratio (Fatom) to carbon element abundance ratio (Catom), Fatom/Catom, at the particle surfaces of the magnetic carrier" to "the ratio of fluorine element abundance ratio (Fcalc) to carbon element abundance ratio (Ccalc) that is theoretically calculable from the molecular structure of the coat resin, Fcalc/Ccalc", i.e., (Fatom/Catom)/(Fcalc/Ccalc), is from 1.01 to 3.00. It may preferably be from 1.10 to 2.00, and more preferably from 1.20 to 1.80.

Where the ratio (Fatom/Catom)/(Fcalc/Ccalc) is within the above range, it means that fluorine elements are preferencially arranged on the particle surfaces of the magnetic carrier in the coat material. In this case, hydrophilic components in the coat material are preferentially arranged on the surfaces of carrier cores, and hence the resistance to peeling from carrier cores can be improved. Also, since fluorine elements are preferentially arranged on the carrier particle surfaces, the releasability of toner from the particle surfaces of the magnetic carrier can be improved. Thus, with the carrier cores, the resistance to peeling from carrier cores is improved in virtue of increase in adhesion, and with the particle surfaces of the magnetic carrier, the releasability is enhanced, and as a result, both of two properties conflicting with each other can be achieved at the same time. In particular, the case where this ratio is from 1.10 to 2.00 is preferable because the magnetic carrier can have a running stability even when applied to high-speed machines having come to have higher process speed.

If the ratio (Fatom/Catom)/(Fcalc/Ccalc) is less than 1.01, the preferential arrangement is not achieved. If it is more than 3.00, the fluorine elements are so excessively arraged as to result in poor durability in the particle surfaces of the magnetic carrier.

The magnetic carrier of the present invention may also preferably have a specific resistance of from $1\times10^{7}$ to $1\times10^{11}$ Ω·cm. If has been found that where the magnetic carrier has specific resistance within this range, it does not cause image defects such as blank areas and can provide images having high image density and superior dot reproducibility.

By regulating the specific resistance of the magnetic carrier within the above range, the electrode effect on the particle surfaces is alleviated, and by controlling the fluorine element abundance ratio at the particle surfaces of the magnetic carrier, the performance of the toner coming away from (or separating from) the magnetic carrier is improved, so that the developing performance of the toner with respect to latent-image potential can be improvred. As a result, elimination of image defects such as blank areas and the improvement of dot reproducibility can be achieved together.

If the magnetic carrier has a specific resistance of less than $1\times10^{7}$ Ω·cm, blank areas may be remedied, but latent images of minute dots may be disrupted, resulting in poor halftone reproducibility in some cases. Also, if the magnetic carrier has a specific resistance of more than $1\times10^{11}$ Ω·cm, blank areas may greatly occur, and also developing performance high enough to satisfy latent-image potential can not be attained to provide poor images in some cases.

The magnetic carrier of the present invention may also preferably have a specific surface area BET 1($m^2$/g) of from 0.02 to 0.20 $m^2$/g as measured by the BET method.

Where the magnetic carrier has specific surface area BET 1 ($m^2$/g) within the above range, the toner and additives used in the toner can be prevented from being contaminated, and besides, the performance of the toner coming away from the magnetic carrier particle surfaces can be improved.

If the specific surface area BET 1 ($m^2$/g) is less than 0.02 $m^2$/g, it has too small specific surface area with respect to the toner, and hence the contact area between the toner and the magnetic carrier particle surfaces comes to be too small. Hence, a poor charge-providing ability may result.

If the specific surface area BET 1 ($m^2$/g) is more than 0.20 $m^2$/g, the contact area of the magnetic carrier with the toner is so large as to lower the toner coming-away performance from the magnetic carrier particle surfaces to cause image defects such as blank areas in some cases. The carrier may have uneven surface properties, so that the stress applied during running and so forth may come non-uniform, and contamination of the toner and additives used in the toner may be promoted.

The magnetic carrier of the present invention can be made to have a high fluorine element abundance ratio if a coat resin having a high fluorine element content is beforehand used in order to make higher the fluorine element abundance ratio at the particle surfaces of the magnetic carrier. This, however, may also allow the peelability from the magnetic carrier to increase. Hence, in order for the coat resin to have also resistance to peeling from carrier cores, carrier cores may preferably be the following.

Magnetic fine particle dispersed resin cores (or carrier cores), which are used as carrier cores of the magnetic carrier of the present invention, may preferably have a specific surface area BET 2($m^2$/g) of from 0.02 to 0.20 $m^2$/g as measured by the BET method.

Where the magnetic fine particle dispersed resin cores (carrier cores) used in the present invention have the specific surface area BET 2within the above range, the adherence of the coat material to the surfaces of the carrier cores is improved, and the resistance to peeling of coat material from carrier cores is improved, so that stable carrier particle surfaces can be maintained even when a high stress is applied at the time of heating or the like. Hence, stable charge-providing performance can be imparted to the carrier, and stable image density can be maintained over a long period of time.

If the specific surface area BET 2is less than 0.02 $m^2$/g, coat thickness may come excess when core surfaces are coated with the coat material, and carrier particles themselves may coalesce, resulting in poor charge-providing performance.

If the specific surface area BET 2is more than 0.20 $m^2$/g, the adhesion of the coat material to core surfaces may be improved, whereas the surface properties of the coated carrier particles may be influenced by the surface properties of the cores, so that the stress applied during running and so forth may be non-uniform and besides, contamination of the toner and additives used in the toner may be promoted.

It is also preferable that the specific surface area BET 1 is from 0.02 to 0.19 $m^2$/g and the specific surface area BET 2is from 0.03 to 0.20 $m^2$/g, where the specific surface area BET 1 and the specific surface area BET 2 satisfy BET 1<BET 2.

Where the specific surface area BET 1 and the specific surface area BET 2are within the above range, the surface stability obtained when the carrier cores are coated with the coat material is improved, the toner and additives can be free from contamination, and the running stability is improved. Further, the magnetic carrier can have the running stability even when applied to high-speed machines having come to have a higher process speed.

If BET 1=BET 2, the magnetic carrier has a larger specific surface area than the carrier core surfaces, so that problems are raised in smoothness of the magnetic carrier particle surfaces or uniformity in the coat material in its coating step, resulting in poor resistance to stress and faulty charging during running.

In the present invention, it is also characteristic that the carrier cores used in the magnetic carrier are magnetic fine particle dispersed resin cores-which contain magnetic fine particles and a binder resin.

When the magnetic fine particle dispersed resin cores are used in the magnetic carrier of the present invention, the carrier core component contains a binder resin, and hence the adherence to the coat material is improved, and the magnetic carrier can have running stability even when applied to high-speed machines having come to have a higher process speed.

In the present invention, the magnetic fine particles used in the magnetic fine particle dispersed resin cores used in the present invention may preferably have a specific surface area BET 3 ($m^2$/g) of from 2.0 to 20.0 $m^2$/g as measured by the BET method.

Where the specific surface area BET 3 ($m^2$/g) of the magnetic fine particles as measured by the BET method is within the above range, the magnetic fine particles can have good dispersibility in the magnetic fine particle dispersed resin cores in producing the magnetic fine particle dispersed resin cores, thus providing good charging uniformity on the magnetic carrier particle surfaces. Also, the surfaces of the magnetic fine particle dispersed resin cores produced can be uniform, which is preferable because the cores can readily uniformly be coated with the coat material.

If the specific surface area BET 3 is less than 2.0 $m^2$/g, the magnetic fine particles may be hard to incorporate in the cores when the magnetic fine particle dispersed resin cores are produced.

If on the other hand the specific surface area BET 3 is more than 20.0 $m^2$/g, the magnetic fine particles themselves may exhibit poor dispersibility when the magnetic fine particle dispersed resin cores are produced, and it is difficult for them to be incorporated in the cores in a uniformly dispersed state. As a result, the specific resistance in the magnetic fine particle dispersed resin cores is made non-uniform, and hence the charge-providing performance to the toner may be unstable.

The magnetic fine particle dispersed resin cores may also contain the magnetic fine particles in an amount of from 70 to 95 parts by weight based on 100 parts by weight of the magnetic fine particle dispersed resin cores. This is preferable in order to allow the magnetic carrier to have a small true specific gravity and secure its mechanical strength sufficiently. The magnetic fine particles may more preferably be in an amount of from 80 to 92 parts by weight.

It is further preferable that in order to convert magnetic properties of the magnetic carrier, the magnetic fine particle dispersed resin cores contain the magnetic fine particles and further non-magnetic fine inorganic-compound particles. It is preferred to contain the magnetic fine particles and further the non-magnetic fine inorganic-compound particles because the non-magnetic fine inorganic-compound particles have a larger specific resistance than the magnetic fine particles and hence the specific resistance of the magnetic fine particle dispersed resin cores can be controlled.

In this case, the magnetic fine particles may be contained in an amount of from 50 to 100% by weight based on the total weight of the magnetic fine particles and non-magnetic fine inorganic-compound particles. This is preferable in order to control the intensity of magnetization of the magnetic carrier to prevent the magnetic carrier adhesion, and further in order to control the specific resistance value of the magnetic carrier.

The magnetic fine particles used in the magnetic fine particle dispersed resin cores in the present invention may preferably be fine magnetite particles, or magnetic fine ferrite particles containing at least an iron element and a magnesium element, and also the non-magnetic fine inorganic-compound particles which may be used in the magnetic fine particle dispersed resin cores may preferably be fine hematite ($\alpha$-$Fe_2O_3$) particles. This is preferable in order to control the magnetic properties and true specific gravity of the magnetic carrier.

It is also preferable that the non-magnetic fine inorganic-compound particles have a specific surface area BET 4 ($m^2/g$) of from 1.0 to 10.0 $m^2/g$ as measured by the BET method, and the specific surface area BET 3 and the specific surface area BET 4 satisfy BET 3>BET 4.

The case is preferred where the non-magnetic fine inorganic-compound particles have a specific surface area BET 4 ($m^2/g$) of from 1.0 to 10.0 $m^2/g$, and the specific surface area BET 3 and the specific surface area BET 4 satisfy BET 3>BET 4, because the dispersibility of the magnetic fine particles in the magnetic fine particle dispersed resin cores is not inhibited when producing the magnetic fine particle dispersed resin cores and further the specific resistance of the magnetic fine particle dispersed resin cores can be controlled.

If the specific surface area BET 4 is less than 1.0 $m^2/g$, the non-magnetic fine inorganic-compound particles may be difficult to incorporate in the cores when the magnetic fine particle dispersed resin cores are produced, and poor charge-providing performance may result, which is undesirable.

If on the other hand the specific surface area BET 4 is more than 10.0 $m^2/g$, the non-magnetic fine inorganic-compound particles themselves may exhibit poor dispersibility when the magnetic fine particle dispersed resin cores are produced, thereby lowering the dispersibility of the magnetic fine particles. Accordingly, the dispersibility of all fine particles in the magnetic fine particle dispersed resin cores is lowered, so that the specific resistance in the magnetic fine particle dispersed resin cores may come non-uniform and the charge-providing performance to the toner may be unstable.

If the specific surface area BET 3 and the specific surface area BET 4 are BET 3=BET 4, the non-magnetic fine inorganic-compound particles may selectively be incorporated in the cores when the magnetic fine particle dispersed resin cores are produced, and the uniformity in the magnetic fine particle dispersed resin cores may be damaged. As a result, the magnetic carrier may have poor charge-providing performance.

The coat resin to be contained in the coat material used in the magnetic carrier of the present invention may specifically include resins including perfluoropolymers such as polyvinyl fluoride, polyvinylidene fluoride, polytrifluoroethylene, polyfluorochloroethylene, polytetrafluoroethylene and polyperfluoropropylene; and a copolymer of vinylidene fluoride and an acrylic monomer, a copolymer of vinylidene fluoride and trifluorochloroethylene, a copolymer of tetrafluoroethylene and hexafluoropropylene, a copolymer of vinyl fluoride and vinylidene fluoride, and a copolymer of vinylidene fluoride and tetrafluoroethylene. In particular, a coat resin used preferably in the present invention is a polymer or copolymer including a methacrylate unit or acrylate unit having a perfluoroalkyl unit represented by the following Formula (1):

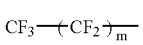

(1)

wherein m represents an integer of 1 to 20.

Any of the coat resins described above may be used alone, or may be used in the form of a mixture. A thermoplastic resin may also be used in which an additive such as a curing agent has been mixed to effect curing.

In the present invention, if m is more than 20, the coat resin tends to precipitate from a solvent to make it difficult to obtain a good coat film in some cases. In order for the coat film to have good toner releasability and coat film-forming properties, it is more preferable that m is 5 to 15, and is still more preferable that m is 5 to 9.

A coat resin having a unit represented by the following Formula (2) also may preferably be used to afford its superior adherence to the carrier cores:

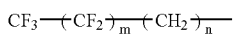

(2)

wherein m is as defined in the above Formula (1), and n represents an integer of 1 to 10.

The coat resin may further preferably be a polymer or copolymer including a unit represented by the following Formula (3):

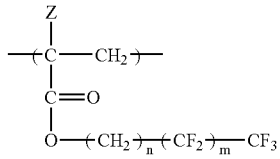

(3)

wherein Z represents a hydrogen atom or an alkyl group, and m and n are as defined in the above Formula (2).

The Z in the above Formula (3) may preferably be a methyl group.

In order to improve the performance of the toner coming away from the carrier, it is preferable for the coat resin to be a copolymer having a unit represented by the following Formula (4) and a unit represented by the following Formula (5):

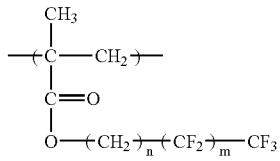

(4)

wherein m and n are as defined in the above Formula (2), and n represents an integer of 1 or more.

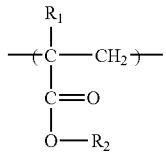

(5)

wherein $R_1$ represents a hydrogen atom or an alkyl group, $R_2$ represents an alkyl group having 1 to 20 carbon atoms, and k represents an integer of 1 or more.

Further, a coat resin obtained by graft-copolymerizing the copolymer units represented by the above Formulas (4) and (5) and the unit represented by the above Formula (4) is particularly preferred because it can maintain the toner coming-away performance even when the magnetic carrier is used over a long period of time and can provide superior resistance to peeling of the coat material from the carrier cores.

In the case where the thermoplastic resin is used as the coat resin to be contained in the coat material, this thermoplastic resin may have a weight-average molecular weight of from 10,000 to 300,000 in gel permeation chromatography (GPC) of its tetrahydrofuran(THF)-soluble component. This is preferable in view of enhancement of the strength of the coat material and the resistance to peeling of the coat material from the magnetic fine particle dispersed resin cores.

The coat resin may preferably have a main peak in the molecular weight region of from 2,000 to 100,000 in a chromatogram in GPC of its THF-soluble matter, and more preferably have a sub-peak or a shoulder in the region of molecular weight of from 2,000 to 100,000. Most preferably, the coat resin may have, in the chromatogram of GPC of its THF-soluble component, a main peak in the region of molecular weight of from 2,000 to 100,000 and have a sub-peak or a shoulder in the region of molecular weight of from 2,000 to 19,000. The feature that the coat resin satisfies the above molecular weight distribution brings more improvement in development durability that allows development on many sheets even in the use of a toner with small particle diameter, charging stability to toners and prevention of external additives from adhering to the particle surfaces of the magnetic carrier.

In the case where the coat resin is the graft copolymer, it is preferable that its backbones have a weight-average molecular weight of from 15,000 to 200,000 and its branches have a weight-average molecular weight of from 3,000 to 10,000. The weight-average molecular weight of the coat resin may be adjusted by controlling conditions for polymerization of the backbone moiety of the graft copolymer or conditions for polymerization of the branch moiety of the graft copolymer.

In the present invention, when the magnetic fine particle dispersed resin cores are coated, the use of a coat material containing the coat resin having the above graft copolymer is preferred in view of superior resistance to peeling of the coat material from the surfaces of the magnetic fine particle dispersed resin cores.

The coat material may preferably be in an amount of from 0.3 to 4.0 parts by weight, more preferably from 0.4 to 3.5 parts by weight, and still more preferably from 0.5 to 3.2 parts by weight, based on 100 parts by weight of the magnetic fine particle dispersed resin cores.

Where the coat material is in the amount within the above range, good toner coming-away performance can be achieved, and the image defects such as blank areas does not easily occur. If it is in an amount of less than 0.3 part by weight, the surfaces of the carrier cores can not sufficiently be coated, and the effect of the present invention may be difficult to exhibit. If on the other hand it is in an amount of more than 4.0 parts by weight, uniform coatings may not be formed to cause charge-up or uncovered carrier core surfaces at which toner-spent may occur. Also, the magnetic carrier may have a high specific resistance to cause image defects such as blank areas.

The magnetic carrier of the present invention may preferably have a contact angle to water of from 95° to 125°, and more preferably from 100° to 120°. If the magnetic carrier has a contact angle to water of less than 95°, the performance of the toner coming away from the magnetic carrier may insufficiently be achived to cause blank areas. If the contact angle to water is more than 125°, the blank areas may be remedied and high developing performance may be achieved, but on the other hand toner scatter may occur when the developing sleeve is rotated at a high speed, causing in-machine contamination.

The coat material may also preferably contain fine particles in an amount of from 1 to 40 parts by weight based on 100 parts by weight of the coat resin.

Inasmuch as the fine particles are contained in the coat material in the amount within the above range, charging stability and toner coming-away performance can be improved, and image defects such as blank areas can be prevented. If the fine particles are in an amount of less than 1 part by weight, the effect brought about by the addition of the fine particles may be not obtainable. If the fine particles are in an amount of more than 40 parts by weight, they may come off from coat layers during running to lower running performance.

The fine particles to be contained in the coat material may preferably have particle diameter having a maximum peak value of from 0.08 μm to 0.70 μm, and more preferably from 0.10 μm to 0.50 μm, in number-based particle size distribution. Inasmuch as the fine particles having the particle diameter within this range are incorporated in the coat material, the toner coming-away performance can be improved. If the particle diameter of the fine particles contained in the coat material has a maximum peak value of less than 0.08 μm, it may be difficult to disperse the fine particles in the coat material. If it has a maximum peak value of more than 0.70 μm, the fine particles may come off from coat layers during running to lower running performance.

As the fine particles contained in the coat material, either of organic fine particles and inorganic fine particles may be used. However, the fine particles contained in the coat material should retain the shape of particles when the magnetic fine particle dispersed resin cores are coated with the coat material. Accordingly, the fine particles contained in the coat material may preferably be fine resin particles or inorganic fine particles, and may more preferably be cross-linked fine resin particles. Stated specifically, usable are fine resin particles such as cross-linked fine polymethyl methacrylate resin particles, cross-linked fine polystyrene resin particles, fine melamine resin particles, fine phenol resin particles and fine nylon resin particles, or inorganic fine particles such as fine silica particles, fine titanium oxide particles and fine alumina particles. Of these, the fine resin particles may be selected from cross-linked fine polymethyl methacrylate resin particles, cross-linked fine polystyrene resin particles and fine melamine resin particles, and one or two or more kinds of fine resin particles may be contained in the coat material, which is preferable from the viewpoint of charging stability.

From the viewpoint of charge control, the coat material may also contain conductive fine particles as the fine particles contained therein.

Stated specifically, the conductive fine particles may preferably be selected from fine carbon black particles, fine magnetite particles, fine graphite particles, fine titanium oxide particles, fine alumina particles, fine zinc oxide particles and fine tin oxide particles, and one or two or more kinds of conductive fine particles may preferably be contained in the coat material. In particular, as fine particles having conductivity, fine carbon black particles are preferred because they have small particle diameter and are usable without damaging the unevenness of the magnetic carrier particle surfaces attributable to fine particles. The fine carbon black particles may preferably have a particle diameter having a maximum peak value of from 10 nm to 60 nm, and more preferably from 15 nm to 50 nm, in number-based particle size distribution. The use of the fine particles having particle diameter within this range is preferable in order to desirably remove electric charges remaining on the particle surfaces of the magnetic carrier and also prevent the fine particles from coming off from the magnetic carrier.

The carbon black (fine carbon black particles) may also have the DBP oil absorption of from 20 to 500 ml/100 g, more preferably from 25 to 300 ml/100 g, and particularly preferably from 30 to 200 ml/100 g.

Where the DBP oil absorption is within the above range, the residual electric charges on the magnetic carrier particle surfaces is efficiently removable, and this is preferable in order to control the charge of the magnetic carrier. If it is less than 20 ml/100 g, the structure of the carbon black is so short that no efficient removal of electric charges may be performed to make it difficult to bring out the effect to be brought by its addition.

Any of these-conductive fine particles may be incorporated in an amount of from 1 to 25 parts by weight based on 100 parts by weight of the coat resin. This is preferable in order for the magnetic carrier not to have too low specific resistance and also in order to remove electric charges remaining on the particle surfaces of the magnetic carrier. If incorporated in an amount of less than 1 part by weight, the effect of removing electric charges remaining on the magnetic carrier particle surfaces may be difficult to sufficiently bring about, and, in an amount of more than 15 parts by weight, the fine particles may unstably be dispersed in the coat material, and besides, because of an excess effect of removing electric charges, the carrier itself may have a low charge-providing performance.

The magnetic carrier of the present invention may preferably have an average particle diameter of from 10 μm to 0.80 μm in number-based particle size distribution. Particles having an average particle diameter of less than 10 μm in number-based particle size distribution tend to cause carrier adhesion. Also, those of more than 80 μm have a small specific surface area with respect to the toner, so taht the toner cannot be sufficiently provided with charges in some cases. In particular, in order to achieve high image quality and prevent carrier adhesion, the magnetic carrier may more preferably have an average particle diameter of from 15 μm to 60 μm, and still more preferably from 20 μm to 45 μm.

To measure the average particle diameter of the magnetic carrier in number-based particle size distribution, at least 300 magnetic-carrier particles of 0.1 μm or more in particle diameter are picked up at random on a scanning electron microscope (100 to 5,000 magnifications), and Fere's diameters in the horizontal direction are measured as magnetic carrier particle diameters by means of a digitizer to calculate therefrom the average particle diameter of the magnetic carrier in its number-based particle size distribution.

The magnetic carrier of the present invention may preferably have the intensity of magnetization ($\sigma 1{,}000$) of from 15 to 80 $Am^2/kg$ (emu/g), and more preferably from 20 to 70 $Am^2/kg$ (emu/g), as measured under application of a magnetic field of $1{,}000\times(103/4\pi)\cdot A/m$ (1,000 oersteds). If the intensity of magnetization ($\sigma 1{,}000$) is more than 80 $Am^2/kg$, stress applied to the toner in the developer magnetic brush increase to cause the toner to deteriorate, and toner-spent on the carrier to occur. If on the other the intensity of magnetization ($\sigma 1{,}000$) is less than 15 $Am^2/kg$, the magnetic carrier may have no magnetic binding force to the developing sleeve, and the carrier may adhere to the photosensitive member surface to cause defects on images.

The magnetic carrier of the present invention may preferably have a true specific gravity of from 2.5 to 4.0 $g/cm^3$, and more preferably from 3.0 to 3.8 $g/cm^3$. The magnetic carrier having true specific gravity within this range is preferable because a less load may be applied to the toner when the magnetic carrier and the toner are agitated and mixed, the toner-spent on the magnetic carrier is restrained and also the carrier is kept from adhering to the photosensitive member.

As a method for producing the magnetic fine particle dispersed resin cores, a method is available in which a monomer for the binder resin and the magnetic fine particles are mixed and the monomer is polymerized to produce the magnetic fine particle dispersed resin cores. Here, as the monomer used in polymerization, usable are vinyl monomers; bisphenols and epichlorohydrin, for forming epoxy resins; phenols and aldehydes, for forming phenol resins; ureas and aldehydes, for forming urea resins; and melamine and aldehydes. For example, as a method of producing magnetic fine particle dispersed resin cores making use of a curable phenol resin, a method is available in which the magnetic fine particles are put in an aqueous medium, and a phenol and an aldehyde are polymerized in this aqueous medium in the presence of a basic catalyst to obtain the magnetic fine particle dispersed resin cores.

As another method of producing the magnetic fine particle dispersed resin cores, a method is available in which a vinyl type or non-vinyl type thermoplastic resin, the magnetic fine particles and other additives are thoroughly mixed by means of a mixer, then the mixture obtained is melt-kneaded using a kneading machine such as a heat roll, a kneader or an extruder, and the kneaded product obtained is cooled, followed by pulverization and classification to obtain magnetic fine particle dispersed resin core particles (or carrier core particles). Here, the magnetic fine particle dispersed resin core particles obtained may preferably be made spherical by a thermal or mechanical means so as to be used as magnetic fine particle dispersed resin core particles for the magnetic carrier. As the binder resin, thermosetting resins such as phenol resins, melamine resins and epoxy resins are preferred in view of their superior durability, impact resistance and heat resistance. As the binder resin, it is more preferable to use a phenol resin in order to more favorably bring out the properties of the magnetic carrier of the present invention.

The phenol for forming the phenol resin may include, besides phenol, compounds having a phenolic hydroxyl group, as exemplified by alkylphenols such as m-cresol, p-tert-butylphenol, o-propylphenol, resorcinol and bisphenol A, and halogenated phenols part or the whole of the benzene nucleus or alkyl group of which has been substituted with a chlorine atom(s) or a bromine atom(s). In particular, phenol(hydroxybenzene) is more preferred.

The aldehyde may include formaldehyde in the form of either of formalin and paraldehyde, and furfural. In particular, formaldehyde is especially preferred.

The molar ratio of the aldehyde to the phenol may preferably be from 1 to 4, and particularly preferably from 1.2 to 3. If the molar ratio of the aldehyde to the phenol is less than 1, the particles may be difficult to form, or, even if formed, the resin may be difficult to cure, and hence the particles formed tend to have a low strength. If on the other hand the molar ratio of the aldehyde to the phenol is more than 4, unreacted aldehydes remaining in the aqueous medium after the reaction tend to increase.

The basic catalyst used in condensation polymerization of the phenol and the aldehyde may include those used in producing usual resol type resins. Such a basic catalyst may include, e.g., ammonia water, hexamethyltetramine and dimethylamine, as well as alkylamines such as diethyltriamine and polyethyleneimine. The molar ratio of any of these basic catalysts to the phenol may preferably be from 0.02 to 0.3.

The two-component developer of the present invention, comprising a toner and a magnetic carrier, is characterized in that the toner has toner particles containing at least a binder resin, a release agent and a colorant; and the magnetic carrier comprises carrier particles, wherein each carrier particle comprises a carrier core and a coat materail for coating the carrier core, the carrier core comprises at least a binder resin and magnetic particles dispersed in the binder resin, and the coat material has a coat resin, where the ratio of fluorine element abundance ratio (Fatom) to carbon element abundance ratio (Catom), Fatom/Catom, at the surface of the carrier particle is from 0.10 to 0.85, and the ratio of the ratio of fluorine element abundance ratio (Fatom) to carbon element abundance ratio (Catom), Fatom/Catom, at the surface of the carrier partilce to the ratio of fluorine element abundance ratio (Fcalc) to carbon element abundance ratio (Ccalc) that is theoretically calculable from the molecular structure of the coat resin, Fcalc/Ccalc, i.e., (Fatom/Catom)/(Fcalc/Ccalc), is from 1.01 to 3.00.

The use of such a two-component developer reduces the contamination of the magnetic carrier due to toner to achieve good running stability. This is because, where the magnetic carrier contained in the magnetic carrier is within the range as defined above, the fluorine element abundance ratio at the particle surfaces of the magnetic carrier can be made higher and hence the surface energy of the particle surfaces of the magnetic carrier can be made small. This enables the releasability of toner from the magnetic carrier particle surfaces to be controlled, and consequently has made it possible to improve the toner coming-away performance at the time of development to remedy the image defects such as blank areas.

The toner in the two-component developer of the present invention is also characterized in that the transmittance of 600 nm wavelength light through a dispersion prepared by dispersing the toner in a 45 vol % methanol aqueous solution is from 10% to 70%. Where the transmittance of 600 nm wavelenght light through a dispersion prepared by dispersing the toner in a 45 vol % methanol aqueous solution is within the above range, the toner can desirably come away from the magnetic carrier even in long-term running, and the blank areas can be prevented from occurring. This transmittance may preferably be from 10% to 60%, and more preferably from 15% to 50%.

When the toner is dispersed in a water/methanol solution, because of the difference in wettability between the binder resin and the release agent which are contained in the toner, the water/methanol solution in which the toner is dispersed comes to differ in concentration depending on a difference in a state in which the release agent is present in the vicinity of the particle surfaces of the toner. In the present invention, this nature is utilized to measure the transmittance as an index of the presence state of the release agent in the vicinity of the particle surfaces of the toner. Also, in the present invention, the 45% by volume methanol aqueous solution (45% by volume of methanol+55% by volume of water) is used because sensitivity to the difference in wettability between the binder resin and the release agent is good when an aqueous methanol solution is used in which the methanol is in a content of about 45% by volume.

That is, in this measuring method, the toner is forcibly dispersed in a methanol/water mixed solvent so that the quantitative characteristics of the release agent such as wax which is present at every particle surface of the toner can readily be brought out, and then the transmittance after a certain time is measured to accurately know the quantity of the release agent such as wax which is present at the toner particle surfaces.

For example, when the wax, which is hydrophobic, is present at the toner particle surfaces in a large quantity, the toner dispersed is not easily wettable to the solvent and does not settle down, and hence the transmittance is at a value of as high as 70%. When on the other hand the wax is present at the toner particle surfaces in a small quantity, a resin such as one in which a polyester unit is present in a large quantity exhibits hydrophilicity because of its strong polarity and dissolves uniformly, so that the transmittance is at a value of as low as 10%.

If the transmittance is less than 10%, the release agent is present in a small quantity in the vicinity of the particle surfaces of the toner, and the developing performance after running may be good and the blank areas as well may be desirbly remedied, but low-temperature fixing performance and gloss may lower. If the transmittance is more than 70%, the low-temperature fixing performance may be good, but the release agent may be liberated from toner particles and move to the developing sleeve or to the particle surfaces of the carrier to contaminate them, so that the developing performance may deteriorate with running and also the blank areas as well may greatly occur.

The transmittance can be adjusted by controlling various conditions such as the temperature and time for pulverization or shape adjustment in producing the toner, the type of the release agent used, and a type of dispersant for the release agent. The transmittance may be measured with a spectrophotometer.

The toner used in the two-component developer of the present invention may also preferably have, in an endothermic curve in measurement by differential thermal analysis (or differential scanning calorimetry DSC), a maximum endothermic peak in the temperature range of from 30° C. to 200° C. and a peak temperature thereof in the range of from 60° C. to 130° C., more preferably in the range of from 65° C. to 125° C., and particularly preferably in the range of from 65° C. to 110° C.

The release agent such as wax may preferably be used in an amount of from 0.1 to 20 parts by weight, and more preferably from 0.5 to 10 parts by weight, based on 100 parts by weight of the binder resin.

The toner used in the present invention may also preferably have, in molecular weight distribution of its resin component as measured by gel permeation chromatography (GPC), a main peak in the molecular weight region of from 3,500 to 15,000, and more preferably in the molecular weight region of from 4,000 to 13,000. It may also preferably have a ratio of weight-average molecular weight (Mw) to number-average molecular weight (Mn), Mw/Mn, of 3.0 or more, and more preferably 5.0 or more. If the toner has a main peak in the molecular weight region of less than 3,500, the toner may have insufficient high-temperature anti-offset properties. If on the other hand it has a main peak in the molecular weight region of more than 15,000, the toner may have no sufficient low-temperature fixing performance and also may have low OHP transparency. If the resin has the Mw/Mn of less than 3.0, anti-offset properties may not be sufficeintly achieved.

The binder resin used in the toner in the two-component developer of the present invention may preferably be one having at least a polyester unit.

The "polyester unit" referred to in the present invention is meant to be a moiety derived from polyester. The components constituting the polyester unit are specifically meant to be dihydric or higher polyhidric alcohol monomer components, and acid monomer components such as a dibasic or higher polycarboxylic acid, a dicarboxilic or higher polycarboxylic anhydride and a dicarboxilic or higher polycarboxilic acid ester.

The toner used in the two-component developer of the present invention may preferably use a resin which is formed of these polyester unit components as a part of raw materials and has a moiety having undergone polycondensation.

The binder resin used in the present invention may preferably be a resin selected from any of i) a polyester resin, ii) a hybrid resin having a polyester unit and a vinyl polymer unit, iii) a mixture of the hybrid resin and a vinyl polymer, iv) a mixture of the hybrid resin and a polyester resin, v) a mixture of a polyester resin, the hybrid resin and a vinyl polymer, and vi) a mixture of a polyester resin and a vinyl polymer.

The hybrid resin is a resin which is formed by ester interchange reaction of polyester unit components with a vinyl polymer unit made up by polymerizing a monomer having a carboxylate group such as an acrylate unit or a methacrylate unit, and may preferably form a graft copolymer (or block copolymer) composed of the vinyl polymer unit as the backbone polymer and the polyester unit as the branch polymer.

As the dihydric or higher polyhidric alcohol monomer component which is a polyester unit component, stated specifically, as a dihydric alcohol component, it may include, e.g., bisphenol-A alkylene oxide addition products such as polyoxypropylene(2.2)-2,2-bis(4-hydroxyphenyl) propane, polyoxypropylene(3.3)-2,2-bis(4-hydroxyphenyl) propane, polyoxyethylene(2.0)-2,2-bis(4-hydroxyphenyl) propane, polyoxypropylene(2.0)-polyoxyethylene(2.0)-2,2-bis(4-hydroxyphenyl)propane and polyoxypropylene(6)-2,2-bis(4-hydroxyphenyl)propane; and ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A and hydrogenated bisphenol A.

As a trihydric or higher polyhidric alcohol monomer component, it may include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

As a dicarboxylic or higher polycarboxilic acid monomer component, it may include aromatic dicarboxylic acids such as phthalic acid, isophthalic acid and terephthalic acid, or anhydrides thereof; alkyldicarboxylic acids such as succinic acid, adipic acid, sebacic acid and azelaic acid, or anhydrides thereof; succinic acids substituted with an alkyl group having 6 to 18 carbon atoms or an alkenyl group having 6 to 18 carbon atoms, or anhydrides thereof; and unsaturated dicarboxylic acids such as fumaric acid, maleic acid and citraconic acid, or anhydrides thereof.

As a tricarboxilic or higher polycarboxylic acid monomer component, it may include polycarboxylic acids such as trimellitic acid, pyromellitic acid and benzophenonetetracarboxylic acid, or anhydrides thereof.

As other monomers, they may include polyhydric alcohols such as oxyalkylene ethers of novolak type phenol resin.

Of these, a resin obtained by polycondensation of a bisphenol derivative represented by the following Formula (6) as the dihydric alcohol monomer component and a carboxylic acid component composed of a dicarboxilic or higher polycarboxylic acid or a anhydride thereof or a lower alkyl ester thereof (e.g., fumaric acid, maleic acid, maleic anhydride, phthalic acid, terephthalic acid, trimellitic acid or pyromellitic acid) as the acid monomer component is particularly preferred because it affords good charge characteristics.

(6)

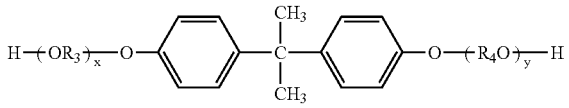

wherein $R_3$ and $R_4$ each independently represent an ethylene group or a propylene group, x and y are each independently an integer of 1 or more, and an average value of x+y is 2 to 10.

The binder resin contained in the toner in the two-component developer of the present invention may preferably be a resin having at least the polyester unit, and, more preferably, the polyester unit components contained in the whole binder resin in the toner may be in an amount of 30% by weight or more based on the whole binder resin in the toner. This is preferable in order to bring out the effect of the present invention. The polyester unit components may more preferably be in an amount of 40% by weight or more, and particularly preferably 50% by weight or more.

Where the polyester unit components contained in the whole binder resin used in toner particles are in an amount of 30% by weight or more, it is preferable in view of fixing performance and charging stability.

As a vinyl monomer for forming the vinyl polymer unit or vinyl polymer used in the hybrid resin, it may include the following: Styrene; styrene derivatives such as o-methylstyrene, m-methylstyrene, p-methylstyrene, α-methylstyrene, p-phenylstyrene, p-ethylstyrenee, 2,4-dimethylstyrene, p-n-butylstyrene, p-tert-butylstyrene, p-n-hexystyelene, p-n-octystyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene; ethylene unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methadrylate; acrylic esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide.

It may further include monomers having carboxyl groups as exemplified by unsaturated dibasic acids such as maleic acid, citraconic acid, itaconic acid, alkenylsuccinic acids, fumaric acid and mesaconic acid; unsaturated dibasic acid anhydrides such as maleic anhydride, citraconic anhydride, itaconic anhydride and alkenylsuccinic anhydrides; half esters of unsaturated dibasic acids, such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half esters, methyl fumarate half ester, and methyl mesaconate half ester; unsaturated dibasic esters such as dimethyl maleate and dimethyl fumarate; α,β-unsaturated acids such as acrylic acid, methacrylic acid, crotonic acid and cinnamic acid; α,β-unsaturated acid anhydrides such as crotonic anhydride and cinnamic anhydride; anhydrides of the α,β-unsaturated acids with lower fatty acids; and alkenylmalonic acids, alkenylglutaric acids, alkenyladipic acids, acid anhydrides of these and monoesters of these.

It may still further include monomers having hydroxyl groups as exemplified by acrylates or methacrylates such as 2-hydroxyethyl acrylate, 2-hydroxyethyl methacrylate and 2-hydroxypropyl methacrylate; and 4-(1-hydroxy-1-methylbutyl)styrene and 4-(1-hydroxy-1-methylhexyl)styrene.

The vinyl polymer or vinyl polymer unit used in the hybrid resin may have cross-linked structure cross-linked with a cross-linking agent having at least two vinyl groups. The cross-linking agent used in such a case may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether linkage, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether linkage, as exemplified by polyoxythylene(2)-2,2-bis(4-hydroxyphenyl) propane diacrylate, polyoxythylene(4)-2,2-bis(4-hydroxyphenyl)propane diacrylate, and the above compounds whose acrylate moiety has been replaced with methacrylate.

As a polyfunctional cross-linking agent, it may include pentaerythritol triacrylate, trimethylolethane triacrylate, trimethylolpropane triacrylate, tetramethylolmethane tetraacrylate, oligoester acrylate, and the above compounds whose acrylate moiety has been replaced with methacrylate; triallylcyanurate, and triallyltrimellitate.

It is preferred for the hybrid resin used in the present invention that the vinyl polymer or vinyl polymer unit and/or the polyester resin or polyester unit is/are incorporated with a monomer capable of reacting with both the resin components. Among monomers constituting the polyester resin or polyester unit, a monomer capable of reacting with the vinyl polymer or vinyl polymer unit may include, e.g., unsaturated dicarboxylic acids such as fumaric acid, maleic acid, citraconic acid and itaconic acid, or anhydrides thereof. Among monomers constituting the vinyl polymer or vinyl polymer unit, a monomer capable of reacting with the polyester resin or polyester unit may include monomers having a carboxyl group or a hydroxyl group, and acrylates or methacrylates.

As a method for obtaining the reaction product of the vinyl polymer with the polyester resin, preferred is a method in which in the presence of a polymer, or a resin, containing monomer components capable of reacting with each of the above vinyl polymer and the above polyester resin are present, polymerization reaction for any one or both of the polymers or resins is carried out.

As a polymerization initiator used when the vinyl polymer or vinyl polymer unit according to the present invention is produced, it may include, e.g., azo compounds such as 2,2'-azobisisobutyronitrile, 2,2'-azobis-(4-methoxy-2,4-dimethylvaleronitrile), 2,2'-azobis-(2,4-dimethylvaleronitrile), 2,2'-azobis-(2-methylbutyronitrile), dimethyl-2,2'-azobisisobutyrate, 1,1'-azobis-(1-cyclohexanecarbonitrile), 2-(carbamoylazo)isobutyronitrile, 2,2'-azobis-(2,4,4-trimethylpentane), 2-phenylazo-2,4-dimethyl-4-methoxyvaleronitrile and 2,2'-azobis-(2-methyl-propane); ketone peroxides such as methyl ethyl ketone peroxide, acetylacetone peroxide and cylcohexanone peroxide; and other types such as 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, di-cumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, di-isopropyl peroxydicarbonate, di-2-ethylhexyl peroxydicarbonate, di-n-propyl peroxydicarbonate, di-2-ethoxyethyl peroxydicarbonate, di-methoxyisopropyl peroxydicarbonate, di(3-methyl-3-methoxybutyl) peroxydicarbonate, acetylcylohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxylbenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydrophthalate and di-t-butyl peroxyazelate.

Methods by which the hybrid resin used in the present invention can be produced may include, e.g., the following production methods shown in (1) to (6).

(1) A method of blending a vinyl polymer and a polyester resin after they have independently been produced. These may be blended by dissolving and swelling them in an organic solvent (e.g., xylene), followed by evaporation of the organic solvent. As the hybrid resin component, the hybrid resin having a polyester unit and a vinyl polymer unit can be obtained which is synthesized by first separately producing a vinyl polymer and a polyester resin, and thereafter dissolving and swelling them in a small amount of an organic solvent, followed by addition of an esterifying catalyst and an alcohol and then heating to effect ester interchange reaction.

(2) A method of first producing a vinyl polymer and thereafter producing a polyester resin in the presence of the vinyl polymer, which are allowed to react to produce the hybrid resin component having a polyester unit and a vinyl polymer unit. The hybrid resin component is produced by allowing the vinyl polymer (a vinyl monomer may optionally be added) to react with a polyester monomer (such as an alcohol or a carboxylic acid) and/or a polyester resin. Also in this case, any organic solvent may appropriately be used.

(3) A method of first producing a polyester resin and thereafter producing a vinyl polymer in the presence of the polyester resin, which are allowed to react to produce the hybrid resin component having a polyester unit and a vinyl polymer unit. The hybrid resin component is produced by allowing the polyester resin (a polyester monomer may optionally be added) to react with a vinyl monomer and/or the vinyl polymer.

(4) A vinyl polymer and a polyester resin are first produced and thereafter a vinyl monomer and/or a polyester monomer (such as an alcohol or a carboxylic acid) is/are added in the presence of these polymer units to produce the hybrid resin component. Also in this case, any organic solvent may appropriately be used.

(5) The hybrid resin component having a polyester unit and a vinyl polymer unit is first produced and thereafter a vinyl monomer and/or a polyester monomer (such as an alcohol or a carboxylic acid) is/are added to effect addition polymerization and/or polycondensation reaction to produce a vinyl polymer and/or a polyester resin, or further produce a hybrid resin component. In this case, as the hybrid resin component having a polyester unit and a vinyl polymer unit, any of those produced by the above methods (2) to (4) may be used, or optionally one produced by any conventional method may also be used. Also, any organic solvent may appropriately be used.

(6) A vinyl monomer and a polyester monomer (such as an alcohol or a carboxylic acid) are mixed to effect addition polymerization and polycondensation reaction continuously to produce a mixture of a vinyl polymer, a polyester resin and the hybrid resin component having a polyester unit and a vinyl polymer unit. Also, any organic solvent may appropriately be used.

In the above production processes (1) to (6), a plurality of polymer units having different molecular weights and different cross-linking degrees may be used as the vinyl polymer unit and/or the polyester unit.

In the present invention, the vinyl polymer or vinyl polymer unit is meant to be a vinyl homopolymer or a vinyl copolymer, or a vinyl homopolymer unit or a vinyl copolymer unit.

The resin having a polyester unit according to the present invention may further have, in molecular weight distribution as measured by gel permeation chromatography (GPC), a main peak in the molecular weight region of from 3,500 to 15,000, and preferably in the molecular weight region of from 4,000 to 13,000, where the ratio of weight-average molecular weight (Mw) to number-average molecular weight (Mn), Mw/Mn, may preferably be 3.0 or more, and more preferably 5.0 or more. If the resin has a main peak in the molecular weight region of less than 3,500, the toner may have insufficient high-temperature anti-offset properties. If on the other hand it has a main peak in the region of molecular weight of more than 15,000, the toner may have no sufficient low-temperature fixing performance and also may have low OHP transparency. If the Mw/Mn is less than 3.0, the anti-offset properties of the resin may not be sufficiently achieved.

The resin having a polyester unit according to the present invention may also preferably have a glass transition temperature (Tg) of from 40° C. to 90° C., and have a softening temperature (Tm) of from 80° C. to 150° C., which is preferable in order to achieve all of storage stability, low-temperature fixing performance, high-temperature anti-offset properties and dispersibility of colorant.

The resin may also have an acid value of less than 50 mg-KOH/g, which is preferable in order to improve development running performance and dispersibility of colorant.

The release agent used in the present invention may include aliphatic hydrocarbon waxes such as low-molecular weight polyethylene, low-molecular weight polypropylene, alkylene copolymers, microcrystalline wax, paraffin wax and Fischer-Tropsch wax; oxides of aliphatic hydrocarbon waxes, such as polyethylene oxide wax, or block copolymers of these; waxes composed chiefly of a fatty ester, such as carnauba wax, behenyl behenate wax and montanate wax, or those obtained by subjecting part or the whole of fatty esters to deoxidizing treatment, such as dioxidized carnauba wax. It may further include saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; esters of fatty acids such as palmitic acid, stearic acid, behenic acid and montanic acid with alcohols such as stearyl alcohol, aralkyl alcohol, behenyl alcohol, carnaubyl alcohol, seryl alcohol and melissyl alcohol; fatty acid amides such as linolic acid amide, oleic acid amide and lauric acid amide; saturated fatty acid bisamides such as methylene bis(stearic acid amide), ethylene bis(capric acid amide), ethylene bis(lauric acid amide) and hexamethylene bis(stearic acid amide); unsaturated fatty acid amides such as ethylene bis(oleic acid amide), hexamethylene bis(oleic acid amide), N,N'-dioleyladipic acid amide and N,N'-dioleylsebasic acid amide; aromatic bisamides such as m-xylene bisstearic acid amide and N,N'-distearylisophthalic acid amide; fatty acid metal salts (those commonly called metal soap) such as calcium stearate, calcium laurate, zinc stearate and magnesium stearate; waxes grafted using vinyl monomers such as styrene and acrylic acid, to fatty acid hydrocarbon waxes; partially esterified products of polyhydric alcohols with fatty acids, such as monoglyceride behenate; and methyl esterified products having a hydroxyl group, obtained by hydrogenation of vegetable fats and oils.

Release agents particularly preferably usable in the present invention may include aliphatic hydrocarbon waxes, and esterified products which are esters of fatty acids with alcohols. For example, preferred are low-molecular weight alkylene polymers obtained by polymerizing alkylenes by radical polymerization under high pressure, or by polymerization under low pressure in the presence of a Ziegler catalyst or a metallocene catalyst; alkylene polymers obtained by thermal decomposition of high-molecular weight alkylene polymers; and synthetic hydrocarbon waxes obtained from, or by hydrogenation of, distillation residues of hydrocarbons obtained by the Arge process from synthetic gases containing carbon monoxide and hydrogen. Hydrocarbon waxes fractionated by using press sweating, solvent fractionation or vacuum distillation, or by a fractionation recrystallization system may more preferably be used.

The hydrocarbons, serving as a matrix, may include those synthesized by reacting carbon monoxide with hydrogen in the presence of a metal oxide type catalyst (preferably catalysts of a two or more multiple system), as exemplified by hydrocarbon compounds obtained by the Synthol process or the Hydrocol process (making use of a fluidized catalyst bed); hydrocarbons having about several hundred carbon atoms, obtained by the Arge process (making use of a fixed catalyst bed), which can produce waxy hydrocarbons in a large quantity; and hydrocarbons obtained by polymerization of alkylenes such as ethylene in the presence of a Ziegler catalyst; all of which are preferable as having less and small branches and being long straight chain saturated hydrocarbons. In particular, waxes synthesized by the method not relying on the polymerization of alkylenes are preferred in view of molecular weight distribution. Paraffin wax may also preferably be used.

The release agent used in the present invention may preferably have, in the endothermic curve in measurement by differential thermal analysis (or differential scanning calorimetry DSC), a maximum endothermic peak in the temperature range of from 30° C. to 200° C. and a peak temperature thereof in the range of from 60° C. to 130° C., more preferably in the range of from 65° C. to 125° C., and particularly preferably in the range of from 65° C. to 110° C.

Where the peak temperature of the maximum endothermic peak of the release agent is in the range of from 60° C. to 130° C., the state of appropriate fine dispersion of the release agent in toner particles can be achieved, which is preferable in order to bring out the effect of the present invention. Meanwhile, if the maximum endothermic peak temperature is less than 60° C., the toner may have poor anti-blocking properties. If on the other hand the maximum endothermic peak temperature is more than 130° C., the toner tends to have poor fixing performance.

As the colorant used in the toner in the two-component developer of the present invention, any known dyes and/or pigments may be used. The pigment may be used alone, but in view of image quality of full-color images, it is more preferable to use the dye and the pigment in combination so that the color sharpness can be improved.

As pigments for magenta toner, they may include condensation azo compounds, diketopyrrolopyrrole compounds, anthraquinone compounds, quinacridone compounds, basic dye lake compounds, naphthol compounds, benzimidazolone compounds, thioindigo compounds and perylene compounds. Stated specifically, they may include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, 254, C.I. Pigment Violet 19, and C.I. Vat Red 1, 2, 10, 13, 15, 23, 29, 35.

As dyes for magenta toner, they may include oil-soluble dyes such as C.I. Solvent Red 1, 3, 8, 23, 24, 25, 27, 30, 49, 81, 82, 83, 84, 100, 109, 121, C.I. Disperse Red 9, C.I. Solvent Violet 8, 13, 14, 21, 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, 40, and C.I. Basic Violet 1, 3, 7, 10, 14, 15, 21, 25, 26, 27, 28.

As pigments for cyan toner, they may include C.I. Pigment Blue 1, 2, 3, 7, 15:1, 15:2, 15:3, 15:4, 16, 17; 60, 62, 66; and C.I. Vat Blue 6, C.I. Acid Blue 45, or copper phthalocyanine pigments whose phthalocyanine skeleton has been substituted with 1 to 5 phthalimide methyl group(s), having a structure represented by the following formula:

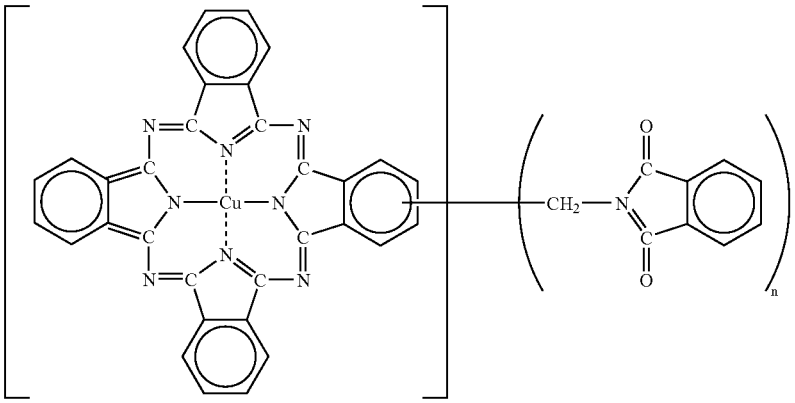

wherein n represents an integer of any of from 1 to 5.

As pigments of yellow toner, they may include condensation azo compounds, isoindolinone compounds, anthraquinone compounds, azo metal complexes, methine compounds and allylamide compounds. Stated specifically, they are C.I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 191, C.I. Vat Yellow 1, 3, 20, and so forth. Also usable are dyes such as C.I. Direct Green 6, C.I. Basic Green 4, C.I. Basic Green 6 and C.I. Solvent Yellow 162.

As black colorants used in the present invention, usable are carbon black, iron oxides, and colorants toned in black by mixing the yellow, magenta and cyan colorants shown above.

In the toner used in the present invention, it is preferable to use one in which the colorant is beforehand mixed in the binder resin used in the present invention to make them into a master batch. Then, this colorant master batch and other materials (such as wax) are melt-kneaded, whereby the colorant can be dispersed well in toner particles.

Where the resin in the present invention is used and the colorant is made into the master batch, the dispersibility of colorant does not deteriorate even when the colorant is used in a large quantity, and besides the dispersibility of colorant in toner particles is improved to bring about superior color reproducibility such as color mixing performance or transparency. Also, a toner having large covering power on the transfer material can be obtained. Still also, since the dispersibility of colorant is improved, the chargeability of the toner is very stable in running (or extensive operation) and the toner can form images with high quality.

In the toner, the colorant may be used in an amount of from 0.1 to 15 parts by weight, more preferably from 0.5 to 12 parts by weight, and most preferably from 2 to 10 parts by weight, based on 100 parts by weight of the binder resin. This is preferable in view of color reproducibility and developing performance.

Any known charge control agents may be used in the toner in the two-component developer of the present invention in order to stabilize the chargeability. Usually, the charge control agent may preferably be contained in toner particles in an amount of from 0.1 to 10 parts by weight, and more preferably from 0.1 to 5 parts by weight, which may differ depending on the type of the charge control agent or the physical properties of toner particle constituent materials. Such a charge control agent is known to include one capable of controlling the toner to be negatively chargeable and one capable of controlling the toner to be positively chargeable. One or more types of various charge control agents may be used according to the types and uses of the toner.

As negative charge control agents, usable are salicylic acid metal compounds, naphthoic acid metal compounds, dicarboxylic acid metal compounds, polymer type compounds having sulfonic acid or carboxylic acid in the side chain, boron compounds, urea compounds, silicon compounds, and carixarene. As positive charge control agents, usable are quaternary ammonium salts, polymer type compounds having such a quaternary ammonium salt in the side chain, guanidine compounds, and imidazole compounds. The charge control agent may internally be added, or may externally be added, to the toner particles.

In particular, where the toner used in the two-component developer of the present invention is a color toner, aromatic carboxylic acid metal compounds are preferred, which are colorless, enable the toner to be charged at high speed and can maintain a certain charge quantity stably.

In the toner used in the two-component developer of the present invention, a fluidity-providing agent may be mixed using a mixing machine such as Henschel mixer after pulverization and classification, whereby the toner can be used in a state that its fluidity has been improved.

As the fluidity-providing agent, any agents may be used as long as improving the fluidity of toner when externally added to colorant-containing resin particles (toner particles), making a comparison between before and after addition. For example, it may include fluorine resin powders such as fine vinylidene fluoride powder and fine polytetrafluoroethylene powder, fine titanium oxide powder, fine alumina powder; fine silica powder such as wet-process silica and dry-process silica, and treated silica obtained by subjecting that fine silica powder to surface treatment (hydrophobic treatment) with a silane compound, an organosilicon compound, a titanium coupling agent or a silicone oil.

For example, as the dry-process silica, named is fine powder produced by vapor phase oxidation of a silicon halide, which is called dry-process silica or fumed silica and is one produced by a conventionally known technique. For example, it utilizes heat decomposition oxidation reaction in oxyhydrogen frame of silicon tetrachloride gas. The reaction basically proceeds as shown in the following scheme.

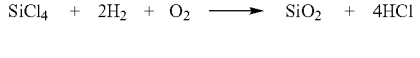

$$SiCl_4 + 2H_2 + O_2 \longrightarrow SiO_2 + 4HCl$$

In this production process, it is also possible to use other metal halide such as aluminum chloride or titanium chloride together with the silicon halide to obtain a composite fine powder of silica with other metal oxide, and the silica includes these as well. As to the particle diameter, it is preferable to use a fine silica powder having an average primary particle diameter within the range of from 0.001 μm to 2 μm, and particularly preferably within the range of from 0.002 μm to 0.2 μm.

In the case of the fine titanium oxide powder, usable are sulfuric acid process titanium compounds, chlorine process titanium compounds and volatile titanium compounds, as exemplified by fine titanium oxide particles produced by low-temperature oxidation (thermal decomposition or hydrolysis) of titanium alkoxides, titanium halides or acetylacetonatotitanium. Crystal forms may be anatase type, rutile type, mixed-crystal form of these, or amorphous, any of which may be used.

In the case of the fine alumina powder, usable are fine alumina particles produced by the Baeyer process, the improved Baeyer process, the ethylene chlorohydrin process, the spark-in-water discharge process, the organic aluminum hydrolysis process, the aluminum-alum thermal decomposition process, the ammonium-aluminum-carbonate thermal decomposition process or the aluminum chloride flame decomposition process. Crystal forms may be alpha, beta, gamma, delta, xi, eta, theta, kappa, chi or rho type, mixed-crystal forms of any of these, or amorphous, any of which may be used. Alpha, delta, gamma or theta type, mixed-crystal form and amorphous ones are preferably used.

Using a method for making hydrophobic, the fine silica powder may be made hydrophobic by chemical or physical treatment with an organosilicon compound or the like capable of reacting with or physically adsorptive on fine inorganic powders.

As a preferable method, the fine silica powder produced by vapor phase oxidation of a silicon halide may be treated with an organosilicon compound. Examples of such an organosilicon compound are hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in its units positioned at the terminals. Any of these may be used alone or in the form of a mixture of two or more types.

As the fluidity-providing agent used in the present invention, one obtained by treating the above dry-process silica with the coupling agent having an amino group or with the silicone oil may be used as needed in order to achieve the objects of the present invention. The fluidity-providing agent used in the present invention may be one having a specific surface area of 30 $m^2/g$ or more, and preferably 50 $m^2/g$ or more, as measured utilizing nitrogen absorption by the BET method, which affords good results. The fluidity-providing agent may be used in an amount of from 0.01 to 8 parts by weight, and preferably from 0.1 to 4 parts by weight, based on 100 parts by weight of the toner particles.

When the two-component developer is prepared by blending the toner and the magnetic carrier of the present invention, they may preferably be blended in a proportion of from 2 to 15% by weight, and more preferably from 4 to 13% by weight, as toner concentration in the developer, where good images are usually obtainable. If the toner concentration is less than 2% by weight, image density tends to lower. If it is more than 15% by weight, fog or in-machine toner scatter tends to occur.

The procedure of producing the toner is described below. The toner used in the two-component developer of the present invention may be produced by mixing the binder resin, the colorant, the wax and any desired materials, melt-kneading the mixture obtained, and cooling and pulverizing the kneaded product, optionally followed by spherical treatment or classification of the pulverized product, and further optionally followed by mixing the above fluidity-providing agent with the resultant product.

First, in the step of mixing the raw materials, at least the resin and the colorant are weighed and compounded as toner internal additives in stated quantities, and mixed. As examples of a mixer therefor, it includes Doublecon Mixer, a V-type mixer, a drum type mixer, Super mixer, Henschel mixer and Nauta mixer.

Further, the toner raw materials compounded and mixed in the above step are melt-kneaded to melt resins and the colorant is dispersed therein. Batch type kneaders such as a pressure kneader and Banbury mixer, or continuous-type kneaders may be used in that melt-kneading step. In recent years, single-screw or twin-screw extruders are prevailing because of an advantage of continuous production. For example, commonly used are a KTK-type twin-screw extruder manufactured by Kobe Steel, Ltd., a TEM-type twin-screw extruder manufactured by Toshiba Machine Co., Ltd.), a twin-screw extruder manufactured by KCK Co., and a co-kneader manufactured by Coperion Buss Ag. A colored resin composition obtained by melt-kneading the toner raw materials is further melt-kneaded, and thereafter rolled by means of a twin-roll mill or the like, followed by cooling through a cooling step where the kneaded colored resin composition is cooled.

Then, in general, the cooled product of the colored resin composition thus obtained is subsequently pulverized in a pulverization step into a product having the desired particle diameter. In the pulverization step, the cooled colored resin composition is first crushed by means of a crusher, a hammer mill, a feather mill or the like, and is further pulverized by means of Criptron system manufactured by Kawasaki Heavy Industries, Ltd., Super rotor manufactured by Nisshin Engineering Inc., or the like. Thereafter, the pulverized product obtained is optionally classified using a sifting machine, e.g., a classifier such as Elbow Jet (manufactured by Nittetsu Mining Co., Ltd.), which is of an inertial classification system, or Turboplex (manufactured by Hosokawa Micron Corporation), which is of a centrifugal classification system, obtaining a classified product with a weight-average particle diameter of from 3 μm to 11 μm.

The classified product may optionally be subjected to surface modification and spherical treatment by means of a hybridization system manufactured by Nara Machinery Co., Ltd. or a mechanofusion system manufactured by Hosokawa Micron Corporation. In such a case, a sifting machine such as an air sifter High Bolter (manufactured by Shin Tokyo Kikai K.K.). As a method for external addition treatment with external additives, a method is further available in which the classified toner particles and known various external additives are compounded in stated quantities and then agitated and mixed using as an external addition machine a high-speed agitator which provide powder with a shear force, such as the Henschel mixer or Super mixer.

Methods for measuring the values of physical properties of the toner and magnetic carrier of the present invention are as follows:

Measurement of BET Specific Surface Area of Magnetic Carrier, Carrier Cores, Magnetic Fine Particles and Non-Magnetic Fine Inorganic-Compound Particles:

First, pretreatment is optionally carried out to prepare samples. For example, in the case of carrier cores such as the magnetic fine particle dispersed resin cores, the magnetic carrier is dissolved in a solvent such as acetone or toluene, and this is left standing for 24 hours to dissolve coat material components completely, followed by separation. Thereafter, the wet carrier cores separated are dried to obtain carrier cores. The magnetic fine particles and/or the non-magnetic inorganic compound which are used in the carrier cores are obtainable by putting the carrier cores in an electric furnace to incinerate resin components completely to obtain an incinerated ash component, and thereafter separating the magnetic fine particles and/or the non-magnetic fine inorganic-compound by means of a magnet.

These samples are measured with a specific surface area measuring instrument TRISTAR 3000 (manufactured by Shimadzu Corporation) according to the BET method, where nitrogen gas is adsorbed on sample particle surfaces, and their specific surface areas are calculated using the BET multiple-point method. Before the specific surface area is measured, 9 g of the sample is precisely weighed and put into a test tube, and vacuuming is carried out for 24 hours at room temperature.

Measurement of Fluorine Element Abundance Ratio and Carbon Element Abundance Ratio at Magnetic Carrier Particle Surfaces:

The fluorine element abundance ratio (Fatom) and carbon element abundance ratio (Catom) at magnetic carrier particle surfaces are measured by X-ray photoelectron spectroscopy (XPS) under the following measuring conditions.

Instrument: QUANTUM 2000, manufactured by PHI Co.

X-ray source: AlKα.

Accelerating voltage: 20 kV.

Catom and Fatom may each be calculated from the peak profile obtained. From their calculated values, the ratio of fluorine element abundance ratio (Fatom) to carbon element abundance ratio (Catom), Fatom/Catom, at particle surfaces of the magnetic carrier may be calculated.

Analysis of Composition of Coat Material:

As a method of separating the coat material from the magnetic carrier, ultrasonic peeling is carried out by means of an ultrasonic dispersion machine, using a solvent (e.g., acetone or toluene) in which the coat material is soluble. Thereafter, using a magnet, the coat material is separated from the carrier cores. Thereafter, using a centrifugal separator, the fine particles added to the coat material may be separated, and the supernatant liquid formed (resin solution component) may be separated, followed by evaporation to dryness, obtaining a coat material resin component. About 50 mg of this sample is put into a sample tube of 5 mm in diameter, and $CDCl_3$ is added as a solvent, followed by dissolution to prepare a measuring sample. Conditions for measurement are shown below.

Measuring instrument: FT NMR device JNM-EX400 (manufactured by Nippon Denshi K.K.).

Measurement frequency: 400 MHz.

Pulse condition: 6.9 μs.

Data points: 32,768.

Frequency range: 10,500 Hz.

Integration times: 16 times.

Measurement temperature: 25° C.

The Fcalc/Ccalc may be calculated from the molecular structure of the coat resin obtained by the above measurement. For example, in a resin component composed of methyl methacrylate and Exemplary Compound 1 represented by the following Formula (7), where the molar ratio of methyl methacrylate to Exemplary Compound 1 is 5:1;

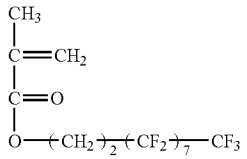

(7)

methyl methacrylate: C, 5; H, 8; O, 2 (atoms); and

Exemplary Compound 1: C, 14; H, 9; O, 2; F, 17 (atoms);

where Fcalc/Ccalc=17/(6×5+14)=0.386;

thus the Fcalc/Ccalc of the coat resin component is 0.386.

Measurement of Specific Resistance of Magnetic Carrier, Magnetic Fine Particles and Non-Magnetic Fine Inorganic-Compound Particles:

The specific resistance values of the magnetic carrier, magnetic fine particles and non-magnetic fine inorganic-compound particles are measured with a measuring instrument shown in FIG. 1. Pretreatment is optionally carried out to prepare samples. The magnetic fine particles and non-magnetic fine inorganic-compound particles used in the magnetic carrier may be obtained in the same manner as the pretreatment for the above measurement of BET specific surface area.

To measure the specific resistance, a method is employed in which a resistance measuring cell E is filled with carrier particles, and a lower electrode 11 and an upper electrode 12 are provided in contact with filled carrier particles 17, where voltage is applied across these electrodes, and electric current flowing at that moment is measured to determine the specific resistance. Conditions for measuring the specific resistance in the present invention are set as follows: Contact area S between filled carrier particles and electrodes: about 2.4 $cm^2$; sample thickness d: about 0.2 cm; and load on the upper electrode 12: 240 g. Voltage is applied in the order of Application Conditions I, II and III, and electric current at voltage applied in Application Conditions III is measured. Thereafter, the sample thickness d is accurately measured, and specific resistance (Ω·cm) at each electric-field intensity (V/cm) is found by calculation. Specific resistance at an electric-field intensity of 3,000 V/cm is regarded as the specific resistance of the sample magnetic carrier. In FIG. 1, reference numeral 13 denotes an insulating material; 14, an ammeter; 15, a voltmeter; 16, a constant-voltage device; and 18, a guide ring.

Application Conditions

I: (changed from 0 V to 1,000 V; raised in steps of 200 V at intervals of 30 seconds)

II: (held at 1,000 V for 30 seconds)

III: (changed from 1,000 V to 0 V; lowered in steps of 200 V at intervals of 30 seconds)

Specific resistance (Ω·cm) of magnetic carrier=(applied voltage (V)/measured electric current (A))×$S$ ($cm^2$)/$d$(cm).

Electric-field intensity (V/cm)=applied voltage (V)/$d$ (cm).

Molecular Weight Distribution Measured by GPC of Binder Resin, Toner and Coat Material:

The molecular weight of chromatograms by gel permeation chromatography (GPC) is measured under the following conditions.

Columns are stabilized in a heat chamber of 40° C. To the columns kept at this temperature, tetrahydrofuran (THF) as a solvent is made to flow at a flow rate of 1 ml per minute, and about 50 to 200 μl of THF sample solution of resin which has been adjusted to have a sample concentration of form 0.05 to 0.6% by weight is injected thereinto to make measurement. In measuring the molecular weight of the sample, the molecular weight distribution of the sample is calculated from the relationship between the logarithmic value of a calibration curve prepared using several kinds of monodisperse polystyrene standard samples and the count number (retention time). The standard polystyrene samples used for the preparation of the calibration curve have molecular weights of 600, 2,100, 4,000, 17,500, 51,000, 110,000, 390,000, 860,000, 2,000,000 and 4,480,000, which are available from Tosoh Corporation or Pressure Chemical Co., and it is suitable to use at least about 10 standard polystyrene samples. An RI (refractive index) detector is used as a detector.

As columns, in order to make precise measurement in the molecular weight region of from 1,000 to 2,000,000, it is desirable to use a plurality of commercially available polystyrene gel columns in combination. For example, they may preferably include a combination of Shodex GPC KF-801, KF-802, KF-803, KF-804, KF-805, KF-806 and KF-807, available from Showa Denko K.K., and μ-Styragel 500, 1,000, 10,000 and 100,000, available from Waters Co.

Measurement of Contact Angle to Water for Magnetic Carrier:

Referring to a method for measuring a contact angle to water for the magnetic carrier, the contact angle to water to water is measured with Wet Tester WTMY-232A Model, manufactured by Sankyo Bioteck Co., Ltd.

13.2 g of the magnetic carrier is gently put into a measuring cell, and tapping is operated for 1 minute at a tapping speed of 30 times/min, using a tapping machine PTM-1 Model, manufactured by Sankyo Bioteck Co., Ltd. This is set in the measuring instrument.

First, the specific surface area of a powder layer is determined by the air permeation method, and then the pressure inflection point is determined by the constant flow rate method. From the two, the contact angle to water to water for powder particles is calculated.

Measurement of Particle Diameter of Fine Particles in Coat Material:

To measure the particle diameter of fine particles in the coat material, components obtained by dissolving the coat material out of the magnetic carrier into a solvent in which the coat material is soluble are observed with a scanning electron microscope (50,000 magnifications), where 500 or more particles of 5 nm or more in particle diameter are picked out at random, and their lengths and breadths are measured by means of a digitizer, and averaged. The resulting value is regarded as the particle diameter, and the number-average particle diameter is calculated on the basis of the particle diameter that corresponds to the peak of particle size distribution of at least 500 particles (from a histogram of columns divided at intervals of 10 nm).

Measurement of Intensity of Magnetization of Magnetic Carrier:

The intensity of magnetization of the magnetic carrier is determined from magnetic properties of the magnetic carrier and from true specific gravity of the magnetic carrier. The magnetic properties of the magnetic carrier may be measured with a vibration magnetic-field type magnetic-property autographic recorder BHV-30, manufactured by Riken Denshi K.K. As a method for the measurement, a cylindrical plastic container is filled with the magnetic carrier in the state it has densely been packed, and an external magnetic field of 79.6 kA/m (1 kOe) is generated. In this state, the magnetic moment of the magnetic carrier filled in the container is measured. Further, the actual weight of the magnetic carrier filled in the container is measured to determine the intensity of magnetization ($Am^2/kg$).

Measurement of True Specific Gravity of Magnetic Carrier:

The true specific gravity of magnetic carrier may be determined by means of a dry automatic densitometer Auto Picnometer.

Measurement of Light Transmittance through Dispersion Prepared by Dispersing Toner in 45% by Volume Methanol Aqueous Solution:

(i) Preparation of Toner Dispersion:

An aqueous solution is prepared in which the volume mixing ratio of methanol to water is 45:55. Then, 10 ml of this aqueous solution is put into a 30 ml sample bottle (SV-30, available from Nichiden-Rika Glass Co., Ltd.), and 20 mg of the toner is soaked therein at the liquid surface, where the bottle is closed. Thereafter, this bottle is shaked at 2.5 $S^{-1}$ for 5 seconds by means of Yayoi shaker (Model: YS-LD). Here, the angle of shaking is so set that the support of shaking moves forward by 15 degrees and backward by 20 degrees where the position just above of the shaker is regarded as 0 degree (vetical). The sample bottle is fastened to a fastening holder attached to the top of the support (the cover of the sample bottle is fastened on the extension of the center of the support). After the sample bottle is taken out, a liquid dispersion after 30 seconds is used as a liquid dispersion for measurement.

(ii) Measurement of Transmittance:

The liquid dispersion obtained in the step (i) is put into a 1 cm square quartz cell, and the transmittance (%) of light 600 nm in wavelength through the liquid dispersion after 10 minutes is measured with a spectrophotometer MPS2000 (manufactured by Shimadzu Corporation).

$$\text{Light transmittance (\%)} = I/I_0 \times 100.$$

where $I_0$: incident-light flux; I: transmitted-light flux.

Measurement of Maximum Endothermic Peak in DSC of Toner and Wax:

The maximum endothermic peak of the toner and wax may be measured with a differential thermal analyzer (differential scanning calorimeter, DSC measuring instrument) DSC2920 (manufactured by TA Instruments Japan Ltd.) according to ASTM D3418-82.

Temperature Curve:

| |
|---|
| Heating I (30° C. to 200° C.; heating rate: 10° C./min). |
| Cooling I (200° C. to 30° C.; Cooling rate: 10° C./min). |
| Heating II (30° C. to 200° C.; heating rate: 10° C./min). |

As a method of the measurement, a sample for measurement is precisely weighed in an amount of from 5 to 20 mg, preferably 10 mg. This sample is put in an aluminum pan and an empty aluminum pan is used as reference. Measurement is made in a normal-temperature and normal-humidity environment at a heating rate of 10° C./min within the measuring temperature range of from 30° C. to 200° C. To determine the maximum endothermic peak of the toner and wax, in the process of Heating II, a peak which is highest from the base line in a region beyond endothermic peaks of the glass transition temperature Tg of the resin or, when the endothermic peak of the glass transition temperature Tg of the resin overlaps with another endothermic peak and are difficult to distinguish, a peak which is highest in the peaks overlapping, is regarded as the maximum endothermic peak of the toner or wax in the present invention.

Measurement of Acid Value of Resin:

Basic operation is made according to JIS K 0070.

(1) A crushed product of a sample is precisely weighed in an amount of from 0.5 to 2.0 g, and the weight of the sample is represented by W (g).
(2) The sample is put in a 300 ml beaker, and 150 ml of a toluene/ethanol (4/1) mixed solvent is added thereto to dissolve the sample.
(3) Using a 0.1 mol/l KOH ethanol solution, titration is made by means of a potentiometric titrator. (For example, automatic titration may be utilized which is carried out using a potentiometric titrator AT-400, WIN WORKSTATION, and an ABP-410 motor burette, manufactured by Kyoto Electronics Manufacturing Co., Ltd.).
(4) The amount of the KOH solution used here is represented by S (ml). A blank is measured at the same time, and the amount of the KOH solution used in the blank is represented by B (ml).
(5) The acid value is calculated according to the following expression. Letter symbol f is the factor of KOH.

$$\text{Acid value (mg·KOH/g)} = ((S-B) \times f \times 5.61)/W.$$

Measurement of Glass Transition Temperature of Resin:

The glass transition temperature (Tg) of the resin is measured according to ASTM D3418-82, using a differential scanning calorimeter (DSC measuring instrument) DSC-7 (manufactured by Perkin-Elmer Corporation) or DSC2920 (manufactured by TA Instruments Japan Ltd.).

A sample for measurement is precisely weighed in an amount of 5 to 20 mg, and preferably 10 mg. This sample is put in an aluminum pan and an empty aluminum pan is used as reference. Measurement is made in a normal-temperature and normal-humidity environment at a heating rate of 10° C./min within the measurement range of from 30° C. to 200° C. In the process of this heating, a change in specific heat are obtained within the temperature range of from 40° C. to 100° C. The intersection of the middle line between base lines of a differential thermal curve before and after the appearance of the change in specific heat and the differential thermal curve is regarded as the glass transition temperature (Tg).

Measurement of Softening Point of Resin:

The softening point refers to what is measured with a falling-type flow tester according to JIS K 7210. A specific measuring method is shown below. Using a fall-type flow tester manufactured by Shimadzu Corporation, 1 $cm^3$ of a sample is heated at a heating rate of 6° C./min while a load of 1,960 $N/m^2$ (20 $kg/cm^2$) is applied by means of a plunger, and a nozzle of 1 mm in diameter and 1 mm in length is so made as to be pushed out, whereby a plunger falling level (flow value)—temperature curve is drawn. Where the height of the sigmoid (S-shaped) curve drawn is represented by h, the temperature corresponding to h/2 (temperature at which a half of the resin has flowed out) is regarded as the softening point (Tm) of the resin.

Measurement of Particle Size Distribution of Toner:

Coulter counter TA-II or Coulter Multisizer II (manufactured by Coulter Electronics, Inc.) is used as a measuring instrument. As an electrolytic solution, an aqueous solution of about 1% NaCl is used. An electrolytic solution prepared using first-grade sodium chloride, e.g., ISOTON R-II (registered trademark; available from Coulter Scientific Japan Co.) may be used as the electrolytic solution.

Referring to a method of the measurement, 0.1 to 5 ml of a surface active agent as a dispersant, preferably an alkylbenzenesulfonate, is added to 100 to 150 ml of the above aqueous electrolytic solution, and further 2 to 20 mg of a sample for measurement is added. The electrolytic solution in which the sample has been suspended is subjected to dispersion for about 1 minute to about 3 minutes in an ultrasonic dispersion machine. The volume distribution and number distribution of the sample are calculated by measuring the volume and number of the sample for each channel by means of the above measuring instrument, using an aperture of 100 μm. Then the weight-average particle diameter of the sample is determined from these distributions. As channels, 13 channels are used, which are of 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm, and 32.00 to 40.30 μm.

EXAMPLES

The present invention is described below by giving specific working examples. The present invention is by no means limited to these working examples.

Production Example of Carrier Cores A

To fine magnetite particles (specific surface area BET 3: 7.0 $m^2/g$; specific resistance: $5\times10^7$ Ω·cm) and fine hematite particles (specific surface area BET 4: 3.8 $m^2/g$; specific resistance: $2\times10^8$ Ω·cm), a silane type coupling agent 3-(2-aminoethylaminopropyl)trimethoxysilane was added in amounts of 4.0% by weight and 2.0% by weight, respectively, and mixed and agitated at high speed in a container at 100° C. or more to carry out lipophilic treatment.

| | |
|---|---|
| Phenol | 10 parts |
| Formaldehyde solution | 6 parts |
| (37% by weight formaldehyde aqueous solution) | |
| Magnetite particles treated as above | 76 parts |
| Hematite particles treated as above | 8 parts |

The above materials and 5 parts by weight of 28% by weight ammonia water and 10 parts by weight of water were put into a flask, and stirred and mixed, during which they were heated to 85° C. over a period of 30 minutes and retained at this temperature, where polymerization reaction was carried out for 3 hours to effect curing. Thereafter, the resultant product was cooled to 30° C., and water was further added thereto, followed by removal of supernatant liquid. The precipitate obtained was washed with water, followed by air drying. Subsequently, this was dried at a temperature of 60° C. under reduced pressure (5 hPa or less) to obtain magnetic fine particle dispersed resin cores (Carrier Cores A) in which magnetic fine particles stood dispersed. The Carrier Cores A obtained had physical properties such that the average particle diameter in number-based particle size distribution was 35 μm and the specific surface area BET 2 was 0.07 $m^2/g$.

Production Example of Carrier Cores B

To fine magnetite particles (specific surface area BET 3: 10.0 $m^2/g$; specific resistance: $2\times10^7$ Ω·cm) and fine hematite particles (specific surface area BET 4: 2.0 $m^2$ μg; specific resistance: $5\times10^8$ Ω·cm), a silane type coupling agent 3-(2-aminoethylaminopropyl)trimethoxysilane was added in amounts of 5.0% by weight and 1.0% by weight, respectively, and mixed and agitated at high speed in a container at 100° C. or more to carry out lipophilic treatment.

| | |
|---|---|
| Phenol | 10 parts |
| Formaldehyde solution | 6 parts |
| (aqueous 37% by weight formaldehyde solution) | |
| Magnetite particles treated as above | 76 parts |
| Hematite particles treated as above | 8 parts |

The above materials and 7 parts by weight of 28% by weight ammonia water and 8 parts by weight of water were put into a flask, and were stirred and mixed, during which these were heated to 85° C. over a period of 30 minutes and retained at this temperature, where polymerization reaction was carried out for 3 hours to effect curing. Thereafter, the resultant product was cooled to 30° C., and water was further added thereto, followed by removal of supernatant liquid. The precipitate obtained was washed with water, followed by air drying. Subsequently, this was dried at a temperature of 60° C. under reduced pressure (5 mmHg or less) to obtain magnetic fine particle dispersed resin cores (Carrier Cores B) in which magnetic fine particles stood dispersed. The Carrier Cores B obtained had physical properties such that the average particle diameter in number-based particle size distribution was 50 μm and the specific surface area BET 2 was 0.08 $m^2/g$.

Production Example of Carrier Cores C

To fine magnetite particles (specific surface area BET 3: 10.0 $m^2/g$; specific resistance: $2\times10^7$ Ω·cm), a titanium type coupling agent isopropyl tri(N-aminoethyl-aminoethyl) titanate was added in an amount of 5.0% by weight, and mixed and agitated at high speed in a container at 100° C. or more to carry out lipophilic treatment.

| | |
|---|---|
| Phenol | 10 parts |
| Formaldehyde solution | 6 parts |
| (aqueous 37% by weight formaldehyde solution) | |
| Magnetite particles treated as above | 84 parts |

The above materials and 6 parts by weight of 28% by weight ammonia water and 12 parts by weight of water were put into a flask, and stirred and mixed, during which these were heated to 85° C. over a period of 30 minutes and retained at this temperature, where polymerization reaction was carried out for 3 hours to effect curing. Thereafter, the resultant product was cooled to 30° C., and water was further added thereto, followed by removal of supernatant liquid. The precipitate obtained was washed with water, followed by air drying. Subsequently, this was dried at a temperature of 60° C. under reduced pressure (5 mmHg or less) to obtain magnetic fine particle dispersed resin cores (Carrier Cores C) in which magnetic fine particles stood dispersed. The Carrier Cores C obtained had physical properties such that the average particle diameter in number-based particle size distribution was 25 μm and the specific surface area BET 2 was 0.10 $m^2/g$.

Production Example of Carrier Cores D $Fe_2O_3$, CuO and MgO were so weighed as to be 52 mol %, 16 mol % and 32 mol %, respectively, in molar ratio, and mixed for 10 hours using a ball mill. The mixture obtained was calcined at 900° C. for 2 hours, followed by pulverization carried out by means of a ball mill, and further followed by granulation carried out by means of a spray dryer. This was sintered at 1,150° C. for 10 hours, and the sintered product obtained was pulverized and further classified to obtain magnetic carrier cores (Carrier Cores D). The Carrier Cores D obtained had physical properties such that their average particle diameter in number-based particle size distribution was 35 μm and specific surface area BET 2 was 0.15 $m^2/g$.

Coat Resin Production Example 1

3 parts by weight of a methyl methacrylate macromer with a weight-average molecular weight of 5,000, having an ethylenically unsaturated group at one terminal, represented by the following Formula (8):

(8)

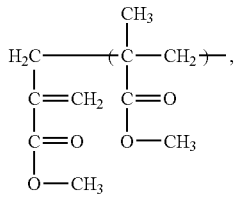

46 parts by weight of Exemplary Compound 1 having a structure represented by the following Formula (7):

(7)

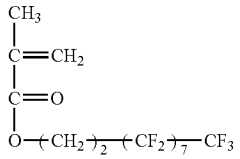

and 51 parts by weight of methyl methacrylate were introduced into a four-necked flask provided with a reflux condenser, a thermometer, a nitrogen suction pipe and a stirrer of a grinding system, and then, 100 parts by weight of toluene, 100 parts by weight of methyl ethyl ketone and 2.4 parts by weight of azobizisovaleronitrile were further added thereto, and kept at 80° C. for 10 hours in a stream of nitrogen to obtain a solution (solid content: 35% by weight) of a graft copolymer (A) having a unit represented by the following Formula (9):

(9)

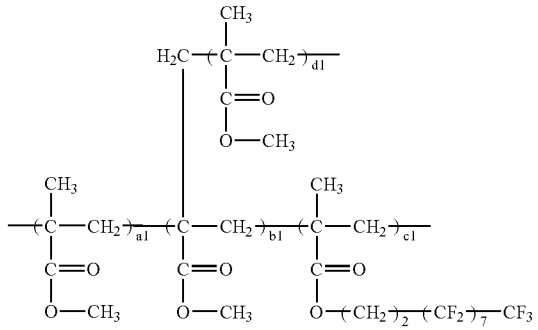

wherein a1, b1, c1 and d1 each independently represent an integer of 1 or more. The graft copolymer (A) had a weight-average molecular weight of 20,000 as measured by gel permeation chromatography (GPC). The graft copolymer (A) had Fcalc/Ccalc of 0.38.

Coat Resin Production Example 2

A graft copolymer (B) having the unit represented by the above Formula (9) was obtained in the same manner as in Coat Resin Production Example 1 except that the compound having the structure represented by the above Formula (7), the methyl methacrylate and the azobizisovaleronitrile were used in amounts changed to 164 parts by weight, 33 parts by weight and 3 parts by weight, respectively. The graft copolymer (B) had a weight-average molecular weight of 23,000 as measured by gel permeation chromatography (GPC). The graft copolymer (B) had Fcalc/Ccalc of 0.48.

Coat Resin Production Example 3

A graft copolymer (C) having the unit represented by the above Formula (9) was obtained in the same manner as in Coat Resin Production Example 1 except that the compound having the structure represented by the above Formula (7) and the methyl methacrylate were used in amounts changed to 17 parts by weight and 90 parts by weight, respectively. The graft copolymer (C) had a weight-average molecular weight of 25,000 as measured by gel permeation chromatography (GPC). The graft copolymer (C) had Fcalc/Ccalc of 0.08.

Coat Resin Production Example 4

A graft copolymer (D) having the unit represented by the above Formula (9) was obtained in the same manner as in Coat Resin Production Example 1 except that the compound having the structure represented by the above Formula (7) and the methyl methacrylate were used in amounts changed to 15 parts by weight and 92 parts by weight, respectively. The graft copolymer (D) had a weight-average molecular weight of 28,000 as measured by gel permeation chromatography (GPC). The graft copolymer (D) had Fcalc/Ccalc of 0.05.

Coat Resin Production Example 5

A graft copolymer (E) having the unit represented by the above Formula (9) was obtained in the same manner as in Coat Resin Production Example 1 except that the compound having the structure represented by the above Formula (7), the methyl methacrylate and the azobizisovaleronitrile were used in amounts changed to 169 parts by weight, 28 parts by weight and 3 parts by weight, respectively. The graft copolymer (E) had a weight-average molecular weight of 24,000 as measured by gel permeation chromatography (GPC). The graft copolymer (E) had Fcalc/Ccalc of 0.50.

Coat Resin Production Example 6

3 parts by weight of a methyl methacrylate macromer with a weight-average molecular weight of 9,000, having an ethylenically unsaturated group at one terminal, represented by the above Formula (8), 49 parts by weight of Exemplary Compound 2 having a structure represented by the following Formula (10):

(10)

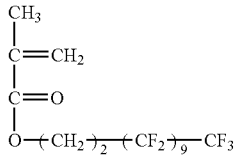

and 48 parts by weight of methyl methacrylate were introduced into a four-necked flask provided with a reflux condenser, a thermometer, a nitrogen suction pipe and a stirrer of a grinding system, and then, 100 parts by weight of methyl ethyl ketone and 0.5 part by weight of azobizisovaleronitrile were further added thereto, and kept at 80° C. for 10 hours in a stream of nitrogen to obtain a solution (solid content: 35% by weight) of a graft copolymer (F) having a unit represented by the following Formula (11):

(11)

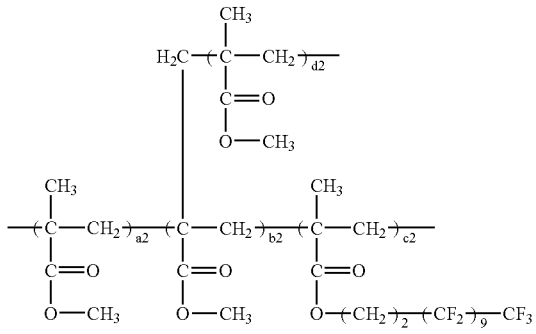

wherein a2, b2, c2 and d2 each independently represent an integer of 1 or more. The graft copolymer (F) had a weight-average molecular weight of 180,000 as measured by gel permeation chromatography (GPC). The graft copolymer (F) had Fcalc/Ccalc of 0.44.

Coat Resin Production Example 7

100 parts by weight of Exemplary Compound 3 represented by the following Formula (12):

(12)

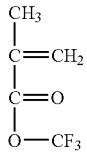

was introduced into a four-necked flask provided with a reflux condenser, a thermometer, a nitrogen suction pipe and a stirrer of a grinding system, and then, 200 parts by weight of methyl ethyl ketone and 1.5 parts by weight of azobizisovaleronitrile were further added thereto, and kept at 80° C. for 10 hours in a stream of nitrogen to obtain a solution (solid content: 35% by weight) of a polymer (G) having a unit represented by the following Formula (13):

(13)

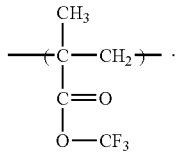

The polymer (G) had a weight-average molecular weight of 30,000 as measured by gel permeation chromatography (GPC). The graft copolymer (G) had Fcalc/Ccalc of 0.80.

Toner Production Example 1

1.1 mol of styrene, 0.14 mol of 2-ethylhexyl acrylate and 0.1 mol of acrylic acid as vinyl polymer unit components, and 0.05 of dicumyl peroxide were put into a dropping funnel. Also, as polyester unit components, 2.0 mols of polyoxypropylene(2.2)-2,2-bis(4-hydroxyphenyl)propane, 0.8 mol of polyoxyethylene(2.2)-2,2-bis(4-hydroxyphenyl) propane, 0.8 mol of terephthalic acid, 0.6 mol of trimellitic anhydride, 1.5 mols of fumaric acid and 0.2 g of dibutyltin oxide were put into a 4-liter four-necked flask made of glass. The flask was placed in a matle heater after attaching a thermometer, a stirring rod, a condenser and a nitrogen feed tube. Next, the inside of the flask was displaced with nitrogen gas, followed by gradual heating with stirring. With stirring at a temperature of 145° C., the monomers, cross-linking agent and polymerization initiator for the vinyl resin were dropwise added to the flask from the dropping funnel over a period of 4 hours. Subsequently, the mixture was heated to 245° C. to carry out reaction for 4 hours to obtain Resin A having a polyester unit. The Resin A was a resin having a weight-average molecular weight of 80,000 and a number-average molecular weight of 3,200.

| | |
|---|---|
| Resin A | 100 parts |
| Paraffin wax (maximum endothermic peak temperature: 78° C.) | 5 parts |
| Aluminum compound of 3,5-di-tert-butylsalicylic acid | 0.5 part |
| C.I. Pigment Blue 15:3 | 5 parts |

The above materials were mixed using a Henschel mixer (FM-75 Type, manufactured by Mitsui Miike Engineering Corporation). Thereafter, the mixture obtained was kneaded by means of a twin-screw kneader (PCM-30 Type, manufactured by Ikegai Corp.) set to a temperature of 130° C. The kneaded product obtained was cooled, and then crushed by means of a hammer mill to a size of 1 mm or less to obtain a crushed product. The crushed product was then pulverized by means of an impact air grinding machine making use of high-pressure air. The pulverized product obtained was further classified by means of a multi-division classifier utilizing the Coanda effect, followed by classification to obtain cyan particles. The cyan particles were surface-modified using a mechanofusion system having a cooling mechanism such as a chiller unit, to obtain cyan particles with a weight-average particle diameter of 6.5 μm.

To 100 parts by weight of the cyan particles obtained, 1.0% by weight of fine titanium oxide particles of 50 nm in primary average particle diameter, having been surface-treated with isobutyltrimethoxysilane was added, and mixed using a Henschel mixer (FM-75 Type, manufactured by Mitsui Miike Engineering Corporation) to produce Toner 1. The light transmittance (%) through the aqueous 45% by volume methanol solution with Toner 1 dispersed therein was 40%.

Toner Production Example 2

| | |
|---|---|
| Resin A | 100 parts |
| Polyethylene wax | 5 parts |
| (maximum endothermic peak temperature: 120° C.) | |
| Aluminum compound of 3,5-di-tert-butylsalicylic acid | 0.5 part |
| C.I. Pigment Blue 15:3 | 5 parts |

Toner 2 was obtained in the same manner as in Toner Production Example 1 except that the materials formulated as above were used and the temperature set for kneading was changed to 150° C. The light transmittance (%) through the aqueous 45% by volume methanol solution with Toner 2 dispersed therein was 65%.

Toner Production Example 3

As polyester unit components, 3.6 mols of polyoxypropylene(2.2)-2,2-bis(4-hydroxyphenyl)propane, 1.6 mol of polyoxyethylene(2.2)-2,2-bis(4-hydroxyphenyl)propane, 1.8 mols of terephthalic acid, 2.5 mols of dodecenylsuccinic acid, 0.5 mol of trimellitic anhydride and 0.2 g of dibutyltin oxide were put into a 4-liter four-necked flask made of glass. The flask was placed in a mantle heater after attaching thermometer, a stirring rod, a condenser and a nitrogen feed tube. Reaction was carried out at 245° C. for 5 hours to produce Resin B having a polyester unit. Resin B was a resin having a weight-average molecular weight of 50,000 and a number-average molecular weight of 3,000.

| | |
|---|---|
| Resin B | 100 parts |
| Polyethylene wax | 5 parts |
| (maximum endothermic peak temperature: 120° C.) | |
| Aluminum compound of 3,5-di-tert-butylsalicylic acid | 0.5 part |
| C.I. Pigment Blue 15:3 | 5 parts |

Toner 3 was obtained in the same manner as in Toner Production Example 1 except that the materials formulated as above were used and the temperature set for kneading was changed to 150° C. The light transmittance (%) through the aqueous 45% by volume methanol solution with Toner 3 dispersed therein was 75%.

Toner Production Example 4

| | |
|---|---|
| Resin A | 100 parts |
| Paraffin wax | 3 parts |
| (maximum endothermic peak temperature: 78° C.) | |
| Aluminum compound of 3,5-di-tert-butylsalicylic acid | 1.0 part |
| C.I. Pigment Blue 15:3 | 4 parts |

Using the materials formulated as above, a crushed product for toner was obtained in the same manner as in Toner Production Example 1, and the crushed product was so pulverized as to obtain a pulverized product with a weight-average particle diameter of 7.5 μm, but without carrying out surface treatment, to produce cyan particles.

To 100 parts by weight of the cyan particles, 1.0% by weight of fine titanium oxide particles of 50 nm in primary average particle diameter, having been surface-treated with isobutyltrimethoxysilane was added, and mixed using a Henschel mixer (FM-75 Type, manufactured by Mitsui Miike Engineering Corporation) to obtain Toner 4. The light transmittance (%) through the aqueous 45% by volume methanol solution with Toner 4 dispersed therein was 15%.

Toner Production Example 5

| | |
|---|---|
| Resin A | 100 parts |
| Aluminum compound of 3,5-di-tert-butylsalicylic acid | 3.0 parts |
| C.I. Pigment Blue 15:3 | 4 parts |

Toner 5 was obtained in the same manner as in Toner Production Example 4 except that the materials formulated as above were used and the temperature set for kneading was changed to 120° C. The light transmittance (%) through the aqueous 45% by volume methanol solution with Toner 5 dispersed therein was 10%.

The transmittance of each of Toners 1 to 5 obtained are shown in Table 1 below.

TABLE 1

| Toner | Transmittance (%) |
|---|---|
| 1 | 40 |
| 2 | 65 |
| 3 | 75 |
| 4 | 15 |
| 5 | 10 |

Example 1

30 parts by weight of a graft copolymer (A) solution was thoroughly mixed with 0.5 part by weight of fine melamine resin particles (average particle diameter in number-based particle size distribution: 0.2 μm), 1.0 part by weight of carbon black (average particle diameter in number-based particle size distribution: 30 nm; DBP oil absorption: 50 ml/100 g) and 100 parts by weight of toluene by means of a homogenizer to prepare a coat solution. Subsequently, while 1,000 parts by weight of Carrier Cores A were agitated under continuous application of a shear force, the coat solution was little by little added thereto, and then the solvent was evaporated at 70° C. to coat carrier particle surfaces with the resin. The magnetic carrier particles thus coated with the resin were heat-treated under agitation at 100° C. for 2 hours, and then rapidly cooled for 1 hour in a 10° C. thermostatic chamber, followed by disintegration and thereafter classification through a sieve of 76 μm in mesh opening to produce Magnetic Carrier 1 having an average particle diameter in number-based particle size distribution of 35 μm, a true specific gravity of 3.6 g/cm$^3$, an intensity of magnetization of 49 Am$^2$/kg, a specific resistance of $8\times10^8$ Ω·cm, a specific surface area BET 1 of 0.05 m$^2$/g and Fatom/Catom of 0.58.

To 90 parts by weight of this Magnetic Carrier 1, 10 parts by weight of Toner 1 was added, and blended by means of a Turbla mixer to make up Two-component Developer 1.

Using this developer and using a remodeled machine of a full-color copying machine CLC5000, manufactured by CANON INC., (which was a machine obtained by modifying CLC5000 in such a way that the laser spot diameter was narrowed so as to effect output at 600 dpi, the surface layer of a fixing roller of a fixing unit was changed to a PFA tube, and an oil application mechanism was detached), images were reproduced in a high-temperature and high-humidity environment (30° C., 85% RH) to make an evaluation. Development was performed under conditions that a developing sleeve and a photosensitive member were rotated in the forward directions at the developing zone, setting the peripheral speed of the developing sleeve 2.0 times that of the photosensitive member, and setting Vd at −600 V, V1 at −110V and Vdc at −450, and also Vpp at 2 kV and frequency at 1.8 kHz. Items of image reproduction evaluation and evaluation criteria are shown below.

(1) Dot Reproducibility:

Using the above toner and the above remodeled machine, 30H images were formed, and the images formed were visually inspected to make an evaluation on dot reproducibility of the images on the basis of the following criteria. In addition, the 30H images refer to a value which indicates 256 gradations by hexadecimal, and are regarded as halftone when OOH is solid white and FFH is solid black.

A: No feeling of coarseness at all, and images are smooth.
B: Almost no feeling of coarseness.
C: There is a feeling of coarseness a little, but it is on the level of no problem in practical use.
D: There is a feeling of coarseness, and it comes into question.
E: There is a feeling of coarseness very much.

(2) Evaluation on Blank Areas:

An evaluation of the blank areas is explained with reference to FIGS. 3A, 3B and 3C.

Figure 3A:
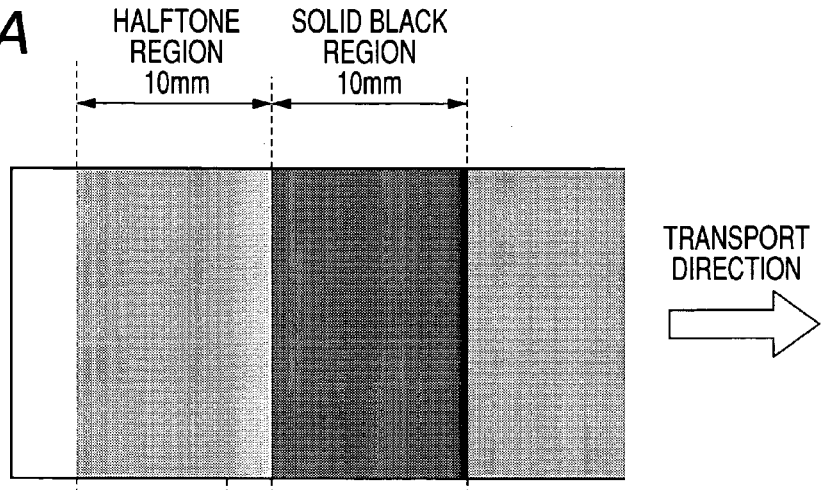
FIGS. 3A, 3B and 3C are illustrations for explaining how to evaluate blank areas.
Figure 3B:
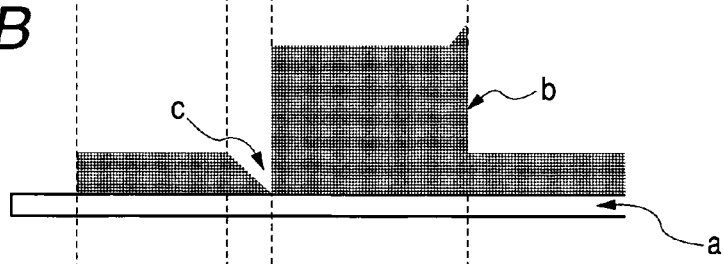
Figure 3C:
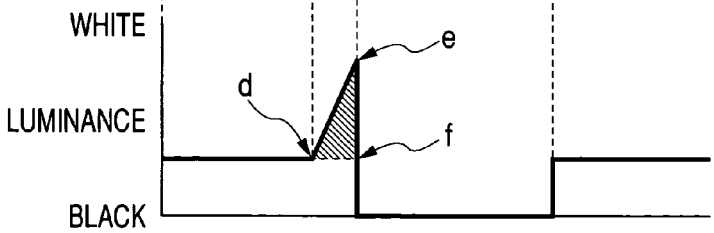

A chart is reproduced in which halftone horizontal zones (30H; 10 mm in width) and solid black horizontal zones (FFH; 10 mm in width) are arranged alternately in the transport direction of a transfer sheet, as shown in FIG. 3A. FIG. 3B shows a cross section of the transfer sheet with the reproduced toner image fixed thereon, where "a" represents a cross section of the transfer sheet, "b" represents a cross section of the toner image fixed on the transfer sheet, and "c" represents a blank area. The image is read with a scanner and binary-coded. FIG. 3C shows luminance distribution taken at 256 gradations on a line in the transport direction of the binary-coded image. In the luminance distribution, the shaded portion enclosed with three lines d-e, e-f and f-d is regarded as a luminance region where "d" is a point from which reduction in the fixed toner amount is started, "e" is a point at which the fixed toner amount is minimal resulting in a blank area, and "f" is a point at which an extension of the luminance of a halftone region having no blank area intersects with a boundary line between a halftone region and a solid black region, and a quotient found by dividing the area of the shaded portion by the sum of the luminance numbers, i.e., (the area of the shaded portion)/(the sum of the luminance numbers) is defined as the degree of blank area.

A: 50 or less. Almost not conspicuous, showing excellent results.
B: From 51 to 150, showing good results.
C: From 151 to 300. Blank areas are seen, but on the level of no problem in practical use.
D: From 301 to 600. Blank areas are conspicuous, and come into question.
E: 601 or more. Blank areas are very conspicuous.

(3) Evaluation of Durability of Coat Material of Carrier:

The two-component developer produced in the present Example was put in a developing assembly of CLC5000, and the developing sleeve was blank-rotated for 1 hour at a process speed of 800 mm/sec in a high-temperature and high-humidity environment (40° C., 80% RH). Thereafter, the two-component developer was sampled from the developing sleeve surface, and the toner and the carrier were separated, where the particle surfaces of the carrier after the blank rotation were observed on a scanning electron microscope (SEM).

A: Carrier particle surfaces have not changed at all.
B: Carrier particle surfaces have somewhat changed, but are on the level of no problem in practical use.
C: Toner adhesion has somewhat occurred.
D: Peeling of the coat material has somewhat occurred.
E: The coat material has peeled, and toner adhesion has occurred.

The values of the physical properties of the carrier produced in the present Example are shown in Table 2. Also, the evaluation resultss of the two-component developer of the present invention in respect of (1) Dot reproducibility, (2) Evaluation on blank areas and (3) Evaluation of durability of coat material of carrier are shown in Table 3.

Example 2

30 parts by weight of a graft copolymer (B) solution was thoroughly mixed with 1.0 part by weight of fine melamine resin particles (average particle diameter in number-based particle size distribution: 0.2 μm), 1.0 part by weight of carbon black (average particle diameter in number-based particle size distribution: 15 nm; DBP oil absorption: 100 ml/100 g) and 100 parts by weight of toluene by means of a homogenizer to prepare a coat solution. Subsequently, while 1,000 parts by weight of Carrier Cores B were agitated under continuous application of a shear force, the coat solution was little by little added thereto, and then the solvent was evaporated at 70° C. to coat carrier particle surfaces with the resin. The magnetic carrier particles thus coated with the resin were heat-treated under agitation at 100° C. for 2 hours, and then rapidly cooled for 1 hour in a 10° C. thermostatic chamber, followed by disintegration and thereafter classification through a sieve of 76 μm in mesh opening to produce Magnetic Carrier 2 having an average particle diameter in number-based particle size distribution of 50 μm, a true specific gravity of 3.6 g/cm$^3$, an intensity of magnetization of 49 Am$^2$/kg, a specific resistance of $2\times10^9$ Ω·cm, a specific surface area BET 1 of 0.04 m$^2$/g and Fatom/Catom of 0.81. The values of physical properties of Carrier 2 are shown in Table 2.

To 90 parts by weight of Magnetic Carrier 2, 10 parts by weight of Toner 1 was added, and blended by means of a Turbla mixer to make up Two-component Developer 2.

Using this developer, evaluation was made in the same manner as in Example 1. The evaluation results in respect of (1) Dot reproducibility, (2) Evaluation on blank areas and (3) Evaluation of durability of coat material of carrier are shown in Table 3.

Example 3

60 parts by weight of a graft copolymer (C) solution was thoroughly mixed with 1.0 part by weight of fine melamine resin particles (average particle diameter in number-based particle size distribution: 0.5 μm) and 100 parts by weight of toluene by means of a homogenizer to prepare a coat solution. Subsequently, while 1,000 parts by weight of Carrier Cores C were agitated under continuous application of a shear force, the coat solution was little by little added thereto, and then the solvent was evaporated at 70° C. to coat carrier particle surfaces with the resin. The magnetic carrier particles thus coated with the resin were heat-treated under agitation at 100° C. for 2 hours, and then rapidly cooled for 1 hour in a 10° C. thermostatic chamber, followed by disintegration and thereafter classification through a sieve of 76 μm in mesh opening to produce Magnetic Carrier 3 having an average particle diameter in number-based particle size distribution of 25 μm, a true specific gravity of 3.6 g/cm$^3$, an intensity of magnetization of 61 Am$^2$/kg, a specific resistance of $9\times10^7$ Ω·cm, a specific surface area BET 1 of 0.08 m$^2$/g and Fatom/Catom of 0.12. The values of physical properties of Carrier 3 are shown in Table 2.

To 90 parts by weight of this Magnetic Carrier 3, 10 parts by weight of Toner 1 was added, and blended by means of a Turbla mixer to make up Two-component Developer 3.

Using this developer, evaluation was made in the same manner as in Example 1. The evaluation resultss in respect of (1) Dot reproducibility, (2) Evaluation on blank areas and (3) Evaluation of durability of coat material of carrier are shown in Table 3.

Comparative Example 1

30 parts by weight of a graft copolymer (C) solution was thoroughly mixed with 2.0 parts by weight of fine melamine resin particles (average particle diameter in number-based particle size distribution: 0.5 μm) and 100 parts by weight of toluene by means of a homogenizer to prepare a coat solution. Subsequently, while 1,000 parts by weight of Carrier Cores D were agitated under continuous application of a shear force, the coat solution was little by little added thereto, and then the solvent was evaporated at 70° C. to coat carrier particle surfaces with the resin. The magnetic carrier particles thus coated with the resin were heat-treated under agitation at 120° C. for 3 hours, and then rapidly cooled for 1 hour in a 10° C. thermostatic chamber, followed by disintegration and thereafter classification through a sieve of 76 μm in mesh opening to produce Magnetic Carrier 4 having an average particle diameter in number-based particle size distribution of 50 μm, a true specific gravity of 5.0 g/cm$^3$, an intensity of magnetization of 63 Am$^2$/kg, a specific resistance of $5\times10^6$ Ω·cm, a specific surface area BET 1 of 0.12 m$^2$/g and Fatom/Catom of 0.13. The values of physical properties of Carrier 4 are shown in Table 2.

To 90 parts by weight of this Magnetic Carrier 4, 10 parts by weight of Toner 1 was added, and blended by means of a Turbla mixer to make up Two-component Developer 4.

Using this developer, an evaluation was made in the same manner as in Example 1. The evaluation resultss in respect of (1) Dot reproducibility, (2) Evaluation on blank areas and (3) Evaluation of durability of coat material of carrier are shown in Table 3.

Comparative Example 2

60 parts by weight of a graft copolymer (D) solution was thoroughly mixed with 3.0 parts by weight of fine polymethyl methacrylate resin particles (average particle diameter in number-based particle size distribution: 1.0 μm) and 100 parts by weight of toluene by means of a homogenizer to prepare a coat solution. Subsequently, while 1,000 parts by weight of Carrier Cores B were agitated under continuous application of a shear force, the coat solution was little by little added thereto, and then the solvent was evaporated at 150° C. to coat carrier particle surfaces with the resin. The magnetic carrier particles thus coated with the resin were heat-treated under agitation at 100° C. for 2 hours, and then rapidly cooled for 1 hour in a 5° C. thermostatic chamber, followed by disintegration and thereafter classification through a sieve of 76 μm in mesh opening to produce Magnetic Carrier 5 having an average particle diameter in number-based particle size distribution of 50 μm, a true specific gravity of 3.6 g/cm$^3$, an intensity of magnetization of 49 Am$^2$/kg, a specific resistance of $5\times10^7$ Ω·cm, a specific surface area BET 1 of 0.11 m$^2$/g and Fatom/Catom of 0.07. The values of physical properties of Carrier 5 are shown in Table 2.

To 90 parts by weight of this Magnetic Carrier 5, 10 parts by weight of Toner 1 was added, and blended by means of a Turbla mixer to make up Two-component Developer 5.

Using this developer, evaluation was made in the same manner as in Example 1. The evaluation results in respect of (1) Dot reproducibility, (2) Evaluation on blank areas and (3) Evaluation of durability of coat material of carrier are shown in Table 3.

Comparative Example 3

60 parts by weight of a graft copolymer (E) solution was thoroughly mixed with 2.0 parts by weight of fine melamine resin particles (average particle diameter in number-based particle size distribution: 0.1 μm), 0.5 part by weight of carbon black (average particle diameter in number-based particle size distribution: 25 nm; DBP oil absorption: 150 ml/100 g) and 100 parts by weight of toluene by means of a homogenizer to prepare a coat solution. Subsequently, while 1,000 parts by weight of Carrier Cores B were agitated under continuous application of a shear force, the coat solution was little by little added thereto, and then the solvent was evaporated at 70° C. to coat carrier particle surfaces with the resin. The magnetic carrier particles thus coated with the resin were heat-treated under agitation at 100° C. for 2 hours, and then rapidly cooled for 1 hour in a 5° C. thermostatic chamber, followed by disintegration and thereafter classification through a sieve of 76 μm in mesh opening to produce Magnetic Carrier 6 having an average particle diameter in number-based particle size distribution of 35 μm, a true specific gravity of 3.6 g/cm$^3$, an intensity of magnetization of 49 Am$^2$/kg, a specific resistance of $5\times10^9$ Ω·cm, a specific surface area BET 1 of 0.05 m$^2$/g and Fatom/Catom of 0.87. The values of physical properties of Carrier 6 are shown in Table 2.

To 90 parts by weight of this Magnetic Carrier 6, 10 parts by weight of Toner 1 was added, and blended by means of a Turbla mixer to make up Two-component Developer 6.

Using this developer, evaluation was made in the same manner as in Example 1. The evaluation resultss in respect of (1) Dot reproducibility, (2) Evaluation on blank areas and (3) Evaluation of durability of coat material of carrier are shown in Table 3.

Example 4

30 parts by weight of a graft copolymer (F) solution was thoroughly mixed with 1.0 part by weight of fine polymethyl methacrylate resin particles (average particle diameter in number-based particle size distribution: 1.0 μm), 0.5 part by weight of carbon black (average particle diameter in number-based particle size distribution: 15 nm; DBP oil absorption: 100 ml/100 g), 50 parts by weight of toluene and 50 parts by weight of methyl ethyl ketone by means of a homogenizer to prepare a coat solution. Subsequently, while 1,000 parts by weight of Carrier Cores B were agitated under continuous application of a shear force, the coat solution was little by little added thereto, and then the solvent was evaporated at 50° C. to coat carrier particle surfaces with the resin. The magnetic carrier particles thus coated with the resin were heat-treated under agitation at 120° C. for 2 hours, and then rapidly cooled for 1 hour in a 5° C. thermostatic chamber, followed by disintegration and thereafter classification through a sieve of 76 μm in mesh opening to produce Magnetic Carrier 7 having an average particle diameter in number-based particle size distribution of 35 μm, a true specific gravity of 3.6 g/cm$^3$, an intensity of magnetization of 49 Am$^2$/kg, a specific resistance of $5\times10^9$ Ω·cm, a specific surface area BET 1 of 0.07 m$^2$/g and Fatom/Catom of 0.61. The values of physical properties of Carrier 7 are shown in Table 2.

To 90 parts by weight of this Magnetic Carrier 7, 10 parts by weight of Toner 1 was added, and blended by means of a Turbla mixer to make up Two-component Developer 7.

Using this developer, an evaluation was made in the same manner as in Example 1. The results of evaluation in respect of (1) Dot reproducibility, (2) Evaluation on blank areas and (3) Evaluation of durability of coat material of carrier are shown in Table 3.

Example 5

60 parts by weight of a graft copolymer (G) solution was thoroughly mixed with 1.0 part by weight of fine melamine resin particles (average particle diameter in number-based particle size distribution: 0.3 μm), 0.5 part by weight of carbon black and 100 parts by weight of toluene by means of a homogenizer to prepare a coat solution. Subsequently, while 1,000 parts by weight of Carrier Cores B were agitated under continuous application of a shear force, the coat solution was little by little added thereto, and then the solvent was evaporated at 50° C. to coat carrier particle surfaces with the resin. The magnetic carrier particles thus coated with the resin were heat-treated under agitation at 120° C. for 2 hours, and then rapidly cooled for 1 hour in a 5° C. thermostatic chamber, followed by disintegration and thereafter classification through a sieve of 76 μm in mesh opening to produce Magnetic Carrier 8 having an average particle diameter in number-based particle size distribution of 35 μm, a true specific gravity of 3.6 g/cm$^3$, an intensity of magnetization of 49 Am$^2$/kg, a specific resistance of $1\times10^9$ Ω·cm, a specific surface area BET 1 of 0.05 m$^2$/g and Fatom/Catom of 0.83. The values of physical properties of Carrier 8 are shown in Table 2.

To 90 parts by weight of this Magnetic Carrier 8, 10 parts by weight of Toner 1 was added, and blended by means of a Turbla mixer to make up Two-component Developer 8.

Using this developer, an evaluation was made in the same manner as in Example 1. The evaluation results in respect of. (1) Dot reproducibility, (2) Evaluation on blank areas and (3) Evaluation of durability of coat material of carrier are shown in Table 3.

Comparative Example 4

10 parts by weight of a graft copolymer (D) solution was thoroughly mixed with 0.5 part by weight of fine melamine resin particles. (average particle diameter in number-based particle size distribution: 0.3 μm), 1.0 part by weight of carbon black and 100 parts by weight of toluene by means of a homogenizer to prepare a coat solution. Subsequently, while 1,000 parts by weight of Carrier Cores D were agitated under continuous application of a shear force, the coat solution was little by little added thereto, and then the solvent was evaporated at 100° C. to coat carrier particle surfaces with the resin. The magnetic carrier particles thus coated with the resin were heat-treated under agitation at 90° C. for 2 hours, and then rapidly cooled for 1 hour in a 5° C. thermostatic chamber, followed by disintegration and thereafter classification through a sieve of 76 μm in mesh opening to produce Magnetic Carrier 9 having an average particle diameter in number-based particle size distribution of 35 μm, a true specific gravity of 3.6 g/cm$^3$, an intensity of magnetization of 63 Am$^2$/kg, a specific resistance of $1\times10^6$ Ω·cm, a specific surface area BET 1 of 0.10 m$^2$/g and Fatom/Catom of 0.11. The values of physical properties of Carrier 9 are shown in Table 2.

To 90 parts by weight of this Magnetic Carrier 9, 10 parts by weight of Toner 1 was added, and blended by means of a Turbla mixer to make up Two-component Developer 9.

Using this developer, evaluation was made in the same manner as in Example 1. The evaluation resultss in respect of (1) Dot reproducibility, (2) Evaluation on blank areas and (3) Evaluation of durability of coat material of carrier are shown in Table 3.

Example 6

30 parts by weight of a graft copolymer (C) solution was thoroughly mixed with 0.5 part by weight of fine melamine resin particles (average particle diameter in number-based particle size distribution: 0.3 μm), 0.5 part by weight of carbon black and 100 parts by weight of toluene by means of a homogenizer to prepare a coat solution. Subsequently, while 1,000 parts by weight of Carrier Cores B were agitated under continuous application of a shear force, the coat solution was little by little added thereto, and then the solvent was evaporated at 100° C. to coat carrier particle surfaces with the resin. The magnetic carrier particles thus coated with the resin were heat-treated under agitation at 90° C. for 2 hours, and then rapidly cooled for 1 hour in a 15° C. thermostatic chamber, followed by disintegration and thereafter classification through a sieve of 76 μm in mesh opening to obtain Magnetic Carrier 10 having an average particle diameter in number-based particle size distribution of 35 μm, a true specific gravity of 3.6 g/cm$^3$, an intensity of magnetization of 49 Am$^2$/kg, a specific resistance of $3\times10^9$ Ω·cm, a specific surface area BET 1 of 0.09 $m^2/g$ and Fatom/Catom of 0.09. The values of physical properties of Carrier 10 are shown in Table 2.

To 90 parts by weight of this Magnetic Carrier 10, 10 parts by weight of Toner 1 was added, and blended by means of a Turbla mixer to make up Two-component Developer 10.

Using this developer, an evaluation was made in the same manner as in Example 1. The evaluation results in respect of (1) Dot reproducibility, (2) Evaluation on blank areas and (3) Evaluation of durability of coat material of carrier are shown in Table 3.

Example 7

To 90 parts by weight of Magnetic Carrier 8, 10 parts by weight of Toner 2 was added, and blended by means of A Turbla mixer to make up Two-component Developer 11.

Using this developer, an evaluation was made in the same manner as in Example 1. The evaluation results in respect of (1) Dot reproducibility, (2) Evaluation on blank areas and (3) Evaluation of durability of coat material of carrier are shown in Table 3.

Comparative Example 5

To 90 parts by weight of Magnetic Carrier 8, 10 parts by weight of Toner 3 was added, and blended by means of A Turbla mixer to make up-Two-component Developer 12.

Using this developer, an evaluation was made in the same manner as in Example 1. The evaluation results in respect of (1) Dot reproducibility, (2) Evaluation on blank areas and (3) Evaluation of durability of coat material of carrier are shown in Table 3.

Example 8

To 90 parts by weight of Magnetic Carrier 7, 10 parts by weight of Toner 2 was added, and blended by means of A Turbla mixer to make up Two-component Developer 13.

Using this developer, an evaluation was made in the same manner as in Example 1. The evaluation results in respect of (1) Dot reproducibility, (2) Evaluation on blank areas and (3) Evaluation of durability of coat material of carrier are shown in Table 3.

Comparative Example 6

To 90 parts by weight of Magnetic Carrier 7, 10 parts by weight of Toner 3 was added, and blended by means of A Turbla mixer to make up Two-component Developer 14.

Using this developer, an evaluation was made in the same manner as in Example 1. The evaluation results in respect of (1) Dot reproducibility, (2) Evaluation on blank areas and (3) Evaluation of durability of coat material of carrier are shown in Table 3.

Example 9

To 90 parts by weight of Magnetic Carrier 7, 10 parts by weight of Toner 4 was added, and blended by means of A Turbla mixer to make up Two-component Developer 15.

Using this developer, an evaluation was made in the same manner as in Example 1. The evaluation results in respect of (1) Dot reproducibility, (2) Evaluation on blank areas and (3) Evaluation of durability of coat material of carrier are shown in Table 3.

Example 10

To 90 parts by weight of Magnetic Carrier 7, 10 parts by weight of Toner 5 was added, and blended by means of A Turbla mixer to make up Two-component Developer 16.

Using this developer, an evaluation was made in the same manner as in Example 1. The evaluation results in respect of (1) Dot reproducibility, (2) Evaluation on blank areas and (3) Evaluation of durability of coat material of carrier are shown in Table 3.

TABLE 2

| Magnetic Carrier: | BET1 ($m^2/g$) | BET2 ($m^2/g$) | Cores | BET3 ($m^2/g$) | BET4 ($m^2/g$) | Coat resin | Fatom/ Catom | Fcalc/ Ccalc | (Fatom/Catom)/ (Fcalc/Ccalc) | Specific resistance (Ω · cm) |
|---|---|---|---|---|---|---|---|---|---|---|
| 1 | 0.05 | 0.07 | A | 7.0 | 3.8 | A | 0.58 | 0.38 | 1.53 | $8 \times 10^8$ |
| 2 | 0.04 | 0.08 | B | 10.0 | 2.0 | B | 0.81 | 0.48 | 1.69 | $2 \times 10^9$ |
| 3 | 0.08 | 0.10 | C | 10.0 | — | C | 0.12 | 0.08 | 1.50 | $9 \times 10^7$ |
| 4 | 0.12 | 0.15 | D | — | — | C | 0.13 | 0.08 | 1.63 | $5 \times 10^6$ |
| 5 | 0.11 | 0.08 | B | 10.0 | 2.0 | D | 0.07 | 0.05 | 1.40 | $5 \times 10^7$ |
| 6 | 0.05 | 0.08 | B | 10.0 | 2.0 | E | 0.87 | 0.50 | 1.74 | $5 \times 10^9$ |
| 7 | 0.07 | 0.08 | B | 10.0 | 2.0 | F | 0.61 | 0.44 | 1.39 | $5 \times 10^9$ |
| 8 | 0.05 | 0.08 | B | 10.0 | 2.0 | G | 0.83 | 0.80 | 1.04 | $1 \times 10^9$ |
| 9 | 0.10 | 0.15 | D | — | — | D | 0.11 | 0.05 | 2.20 | $1 \times 10^6$ |
| 10 | 0.09 | 0.08 | B | 10.0 | 2.0 | C | 0.09 | 0.08 | 1.13 | $3 \times 10^9$ |

TABLE 3

| | Developer | Toner | Transmittance (%) | Magnetic carrier | Dot reproducibility | Blank area evaluation | Coat material durability evaluation |
|---|---|---|---|---|---|---|---|
| Example: | | | | | | | |
| 1 | 1 | 1 | 40 | 1 | A | A(35) | A |
| 2 | 2 | 1 | 40 | 2 | A | B(140) | B |
| 3 | 3 | 1 | 40 | 3 | B | A(40) | A |

TABLE 3-continued

| | Developer | Toner | Transmittance (%) | Magnetic carrier | Dot reproducibility | Blank area evaluation | Coat material durability evaluation |
|---|---|---|---|---|---|---|---|
| Comparative Example: | | | | | | | |
| 1 | 4 | 1 | 40 | 4 | D | B(120) | C |
| 2 | 5 | 1 | 40 | 5 | C | E(750) | D |
| 3 | 6 | 1 | 40 | 6 | D | C(280) | C |
| Example: | | | | | | | |
| 4 | 7 | 1 | 40 | 7 | A | C(250) | A |
| 5 | 8 | 1 | 40 | 8 | B | C(280) | C |
| Comparative Example: | | | | | | | |
| 4 | 9 | 1 | 40 | 9 | E | E(680) | E |
| Example: | | | | | | | |
| 6 | 10 | 1 | 40 | 10 | A | C(250) | B |
| 7 | 11 | 2 | 65 | 8 | C | C(250) | C |
| Comparative Example: | | | | | | | |
| 5 | 12 | 3 | 75 | 8 | D | D(350) | C |
| Example: | | | | | | | |
| 8 | 13 | 2 | 65 | 7 | B | C(300) | A |
| Comparative Example: | | | | | | | |
| 6 | 14 | 3 | 75 | 7 | E | D(350) | B |
| Example: | | | | | | | |
| 9 | 15 | 4 | 15 | 7 | A | B(150) | B |
| 10 | 16 | 5 | 10 | 7 | C | B(180) | C |

What is claimed is:

1. A magnetic carrier comprising carrier particles, wherein:

a BET specific surface area (BET 1) of the magnetic carrier is from 0.02 $m^2/g$ to 0.20 $m^2/g$ as measured by a BET method, each carrier particle comprises a carrier core and a coat material for coating the carrier core, the carrier core comprises at least a binder resin and magnetic particles dispersed in the binder resin, the coat material has a coat resin, a ratio (A) of a fluorine element abundance ratio (Fatom) to a carbon element abundance ratio (Catom), Fatom/Catom, at a surface of the carrier particle is from 0.10 to 0.85, and a ratio ((A)/(B)) of a ratio (A) of a fluorine element abundance ratio (Fatom) to a carbon element abundance ratio (Catom), Fatom/Catom, at a surface of the carrier particle to a ratio (B) of a fluorine element abundance ratio (Fcalc) to a carbon element abundance ratio (Ccalc) that is theoretically calculable from molecular structure of the coat resin, Fcalc/Ccalc is from 1.01 to 3.00.

2. The magnetic carrier according to claim 1, wherein said ratio (Fatom/Catom)/(Fcalc/Ccalc) is from 1.10 to 2.00.

3. The magnetic carrier according to claim 1, which has a specific resistance of from $1\times10^7$ Ω·cm to $1\times10^{11}$ Ω·cm.

4. The magnetic carrier according to claim 1, wherein said carrier cores have a BET specific surface area (BET 2) of from 0.02 $m^2/g$ to 0.20 $m^2/g$ as measured by a BET method.

5. The magnetic carrier according to claim 4, wherein said BET specific surface area (BET 1) is from 0.02 $m^2/g$ to 0.19 $m^2/g$ and said BET specific surface area (BET 2) is from 0.03 $m^2/g$ to 0.20 $m^2/g$, where said BET specific surface area (BET 1) and said BET specific surface area (BET 2) satisfy BET 1<BET 2.

6. The magnetic carrier according to claim 1, wherein said magnetic particles have a BET specific surface area (BET 3) of from 2.0 $m^2/g$ to 20.0 $m^2/g$ as measured by a BET method.

7. The magnetic carrier according to claim 1, wherein said carrier cores contain said magnetic particles and further non-magnetic inorganic-compound particles.

8. The magnetic carrier according to claim 7, wherein said non-magnetic inorganic-compound particles have a BET specific surface area (BET 4) of from 1.0 $m^2/g$ to 10.0 $m^2/g$ as measured by a BET method, and said BET specific surface area (BET 3) and said BET specific surface area (BET 4) satisfy BET 3>BET 4.

9. The magnetic carrier according to claim 1, wherein said coat resin is a polymer or copolymer constituted of a methacrylate unit or acrylate unit having a perfluoroalkyl unit represented by the formula:

$$CF_3-(CF_2)_m-$$

wherein m represents an integer of 1 to 20.

10. The magnetic carrier according to claim 1, wherein said coat resin is a polymer or copolymer comprising a methacrylate unit or acrylate unit having a perfluoroalkyl unit represented by the formula:

$$CF_3-(CF_2)_m-$$

wherein m represents an integer of 5 to 9.

11. The magnetic carrier according to claim 1, wherein said coat resin is a polymer or copolymer comprising a unit represented by the formula:

$$-(C(Z)-CH_2)-$$
$$C=O$$
$$O-(CH_2)_n-(CF_2)_m-CF_3$$

wherein Z represents a hydrogen atom or an alkyl group, m represents an integer of 1 to 20, and n represents an integer of 1 to 10.

12. The magnetic carrier according to claim 1, wherein said coat material is in an amount of from 0.3 part by weight to 4.0 parts by weight based on 100 parts by weight of said carrier core.

13. The magnetic carrier according to claim 1, which has a contact angle to water of from 95° to 125°.

14. The magnetic carrier according to claim 1, wherein said coat material contains fine particles in an amount of from 1 part by weight to 40 parts by weight based on 100 parts by weight of said coat resin.

15. The magnetic carrier according to claim 14, wherein said fine particles contained in said coat material are at least one of fine resin particles and conductive fine particles.

16. The magnetic carrier according to claim 15, wherein said fine resin particles are fine resin particles selected from the group consisting of cross-linked fine polymethyl methacrylate resin particles, cross-linked fine polystyrene resin particles and fine melamine resin particles; and one or two or more kinds of fine resin particles are contained.

17. The magnetic carrier according to claim 15, wherein said conductive fine particles are conductive fine particles selected from the group consisting of fine carbon black particles, fine magnetite particles, fine graphite particles, fine titanium oxide particles, fine alumina particles, fine zinc oxide particles and fine tin oxide particles.

18. The magnetic carrier according to claim 1, wherein said carrier cores contain said magnetic particles in an amount of from 70 parts by weight to 95 parts by weight based on 100 parts by weight of said carrier cores.

19. The magnetic carrier according to claim 1, which has a true specific gravity of from 2.5 g/cm$^3$ to 4.0 g/cm$^3$.

20. A two-component developer comprising a toner and a magnetic carrier, wherein:

said toner has toner particles containing at least a binder resin, a release agent and a colorant, and the transmittance of light having a wavelength of 600 nm through a dispersion prepared by dispersing said toner in an aqueous 45% by volume methanol solution is from 10% to 70%; and said magnetic carrier has a BET specific surface area (BET 1) from 0.02 m$^2$/g to 0.20 m$^2$/g as measured by a BET method, and comprises carrier particles, wherein:

each carrier particle comprises a carrier core and a coat material for coating the carrier core, the carrier core comprises at least a binder resin and magnetic particles dispersed in the binder resin, the coat material has a coat resin, a ratio (A) of a fluorine element abundance ratio (Fatom) to a carbon element abundance ratio (Catom), Fatom/Catom, at a surface of said carrier particle is from 0.10 to 0.85, and a ratio ((A)/(B)) of a ratio (A) of fluorine element abundance ratio (Fatom) to a carbon element abundance ratio (Catom), Fatom/Catom, at a surface of said carrier particle to a ratio (B) of a fluorine element abundance ratio (Fcalc) to a carbon element abundance ratio (Ccalc) that is theoretically calculable from molecular structure of the coat resin, Fcalc/Ccalc is from 1.01 to 3.00.

21. A two-component developer comprising a toner and a magnetic carrier, wherein:

said toner has toner particles containing at least a binder resin, a release agent and a colorant, and the transmittance of light having a wavelength of 600 nm through a dispersion prepared by dispersing said toner in an aqueous 45% by volume methanol solution is from 10% to 70%; and wherein said magnetic carrier is the magnetic carrier according to any one of claims 2, 3 or 4-19.

* * * * *